US009403369B2

(12) United States Patent
Hara

(10) Patent No.: US 9,403,369 B2
(45) Date of Patent: Aug. 2, 2016

(54) FLOW CHANNEL MEMBER, LIQUID EJECTING HEAD, AND LIQUID EJECTING APPARATUS

(71) Applicant: SEIKO EPSON CORPORATION, Tokyo (JP)

(72) Inventor: Keiji Hara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 13/852,430

(22) Filed: Mar. 28, 2013

(65) Prior Publication Data

US 2013/0327852 A1 Dec. 12, 2013

(30) Foreign Application Priority Data

Jun. 8, 2012 (JP) ..... 2012-131407
Mar. 26, 2013 (JP) ..... 2013-065266

(51) Int. Cl.
*B41J 2/14* (2006.01)
*B41J 2/175* (2006.01)
*B41J 2/19* (2006.01)

(52) U.S. Cl.
CPC ..... *B41J 2/175* (2013.01); *B41J 2/17523* (2013.01); *B41J 2/19* (2013.01); *B41J 2/1404* (2013.01); *B41J 2/14032* (2013.01); *B41J 2/17513* (2013.01); *Y10T 137/86292* (2015.04)

(58) Field of Classification Search
CPC .... B41J 2/175; B41J 2/17523; B41J 2/17513; B41J 2/14032; B41J 2/1404
See application file for complete search history.

(56) References Cited

U.S. PATENT DOCUMENTS

2013/0033539 A1 * 2/2013 Watanabe et al. ..... 347/20

FOREIGN PATENT DOCUMENTS

JP 2007-260948 10/2007

* cited by examiner

*Primary Examiner* — Lisa M Solomon
(74) *Attorney, Agent, or Firm* — Workman Nydegger

(57) ABSTRACT

The flow channel member includes an attachment member having a first flow channel to be connected to an ink cartridge; a flow channel plate having a second flow channel to be connected to a head main body ejecting an ink; an adhesive arranged on a first joining surface and a second joining surface where the attachment member and the flow channel plate are opposing each other, and enclosing openings of the first flow channel and the second flow channel; a seal member arranged on the joining surfaces, enclosing an outer side of the adhesive; and an air chamber between the adhesive and the seal member, in which a communication channel allowing the air chamber to communicate outward is disposed in the attachment member, and the communication channel is capable of communicating with an outward open channel of the ink cartridge.

19 Claims, 14 Drawing Sheets

FLOW CHANNEL MEMBER, LIQUID EJECTING HEAD, AND LIQUID EJECTING APPARATUS

The entire disclosure of Japanese Patent Application Nos. 2012-131407, filed Jun. 8, 2012, and 2013-065266, filed Mar. 26, 2013 are incorporated by reference herein.

TECHNICAL FIELD

The present invention relates to a flow channel member, a liquid ejecting head, and a liquid ejecting apparatus.

BACKGROUND ART

As an example of a liquid ejecting head, there is an ink jet type recording head which includes a head main body ejecting an ink, and a flow channel member having an ink flow channel supplying the ink to each nozzle opening of the head main body (for example, refer to PTL 1). For example, the head main body has a manifold where the ink is stored, directs the ink into each pressure generation chamber communicating with the manifold, and deforms the pressure generation chamber using power generation means such as a piezoelectric element so as to eject a liquid from nozzles.

As the flow channel member, there is one which includes a first member and a second member with a seal member interposed therebetween such that a closed space is formed between the surfaces of the first member and the second member, and the seal member. Within the closed space, an ink flow channel is configured such that a first flow channel disposed on the first member and a second flow channel disposed on the second member communicate with each other, and the opposing surfaces on the periphery of the ink flow channel are bonded to each other with an adhesive.

CITATION LIST

Patent Literature

[PTL 1] JP-A-2007-260948

SUMMARY OF INVENTION

Technical Problem

In such a flow channel member, there is a possibility that, due to a cured adhesive or changes in an environmental temperature, air inside the closed space may expand and infiltrate into the ink flow channel by passing through the adhesive. The air that has infiltrated into the ink flow channel may become bubbles, which may cause poor ink ejection.

Furthermore, in some cases, an outward open channel which discharges the air inside a head main body outward is disposed in the flow channel member. Specifically, a compliance substrate absorbing pressure changes inside a manifold and a compliance space so as not to inhibit deformation of the compliance substrate are disposed in the head main body. Thus, the flow channel member includes the one which has the outward open channel communicating outward. In such an ink jet type recording head, since the compliance space communicates outward via the outward open channel, the deformation of the compliance substrate is not inhibited.

The outward open channel is formed to meander within the flow channel member. If diffusion resistance is increased in the outward open channel by allowing such meandering, excessive evaporation of moisture is suppressed in the ink of the manifold.

However, in order to form the meandering outward open channel, it is necessary to provide a predetermined space in the flow channel member. Therefore, a problem arises that the ink jet type recording medium head may be increased in size.

The problem described above is similarly present even in the flow channel member mounted on other devices and is not limited to the flow channel member mounted on the ink jet type recording head.

The invention aims to provide a flow channel member, a liquid ejecting head, and a liquid ejecting apparatus which can suppress bubbles from being mixed into a liquid and can be decreased in size.

Solution to Problem

In order to solve the above problems, according to an aspect of the invention, there is provided a flow channel member which includes a first member having a first flow channel to be connected to liquid supply means for supplying a liquid; a second member having a second flow channel downstream from the first flow channel, and being joined to the first member; a first joining section arranged on joining surfaces where the first member and the second member oppose each other, enclosing openings of the first flow channel and the second flow channel; a second joining section arranged on the joining surfaces, and enclosing the first joining section; and an air chamber accumulating air between the first joining section and the second joining section, in which a communication channel allowing the air chamber to communicate outward is disposed inside at least any one of the first member and the second member.

In this aspect, the air inside the air chamber defined in the flow channel member comes to have the same pressure as that of the outside, and thereby expanding and high pressurizing due to changes in a temperature are suppressed. Therefore, it is possible to suppress infiltration of the air inside the air chamber into the first joining section, which results from a higher pressure than the outside, and to suppress permeation of the air into a liquid flow channel. Since the air is not mixed into the liquid flow channel in this manner, it is possible to supply the head main body with the liquid having no bubble mixed. In addition, since the flow channel member does not have a meandering air flow channel for imparting diffusion resistance, it is possible to decrease the flow channel member in size.

Here, it is preferable that the communication channel of the first member do not have a pressure adjustment section adjusting a pressure inside the air chamber, and the communication channel of the first member be capable of communicating with the pressure adjustment section disposed in the liquid supply means to be attached to the first member. Accordingly, since the liquid supply means is allowed to have the pressure adjustment section adjusting the pressure inside the air chamber, the pressure adjustment section may not be formed in the flow channel member. In this manner, it is possible to decrease the flow channel member in size.

In addition, it is preferable that the pressure adjustment section release the air outward and impart diffusion resistance to the circulating air. Accordingly, it is possible to adjust the pressure in the air chamber.

In addition, it is preferable that the first flow channel have a vertical flow channel penetrating the first member in a thickness direction and a horizontal flow channel disposed on the joining surfaces and communicating with the vertical flow channel. Accordingly, since the liquid flow channel has the horizontal flow channel, it is possible to shorten the length of the liquid flow channel in the thickness direction and thereby it is possible to decrease the size of the flow channel member in the thickness direction.

In addition, it is preferable that the first joining section have a higher air permeability or vapor permeability of a liquid than any one among the second joining section, the first member and the second member. Accordingly, it is possible to suppress permeation of water vapor, using the second joining section, the first member and the second member, by securing resistance to the liquid such that the liquid in the liquid flow channel may not leak out from the first joining section.

In addition, according to another aspect of the invention, there is provided a liquid ejecting head including the above-described flow channel member and a head main body.

In this aspect, it is possible to achieve the liquid ejecting head which can suppress the bubble mixing into the liquid and can be decreased in size.

In addition, it is preferable that the head main body have a plurality of nozzles ejecting a liquid, a manifold which becomes a common storage section for the liquid to be supplied to the nozzles, a flexible compliance section partially defining the manifold, and a compliance space disposed to oppose the compliance section, and the compliance space communicate with the air chamber. Accordingly, the compliance space communicates outward via the communication channel and the outward open channel. In this manner, it is possible to keep favorable deformation of the compliance section and to suppress excessive evaporation of the moisture of the liquid inside the manifold.

In addition, it is preferable that a flow channel communicating with the compliance space and the air chamber do not include a pressure adjustment section adjusting a pressure inside the air chamber. Accordingly, it is possible to decrease the size of the flow channel member since the pressure adjustment section is not disposed in the flow channel.

Furthermore, according to still another aspect of the invention, there is provided a liquid ejecting apparatus including the above-described liquid ejecting head.

In this aspect, it is possible to achieve the liquid ejecting apparatus which can suppress the bubble mixing into the liquid and can be decreased in size.

DESCRIPTION OF EMBODIMENTS

Embodiment 1

The invention will be described in detail based on exemplary embodiments. An ink jet type recording head is an example of a liquid ejecting head, and is also simply referred to as a head. An ink jet type recording apparatus is an example of a liquid ejecting apparatus.

Figure 1:
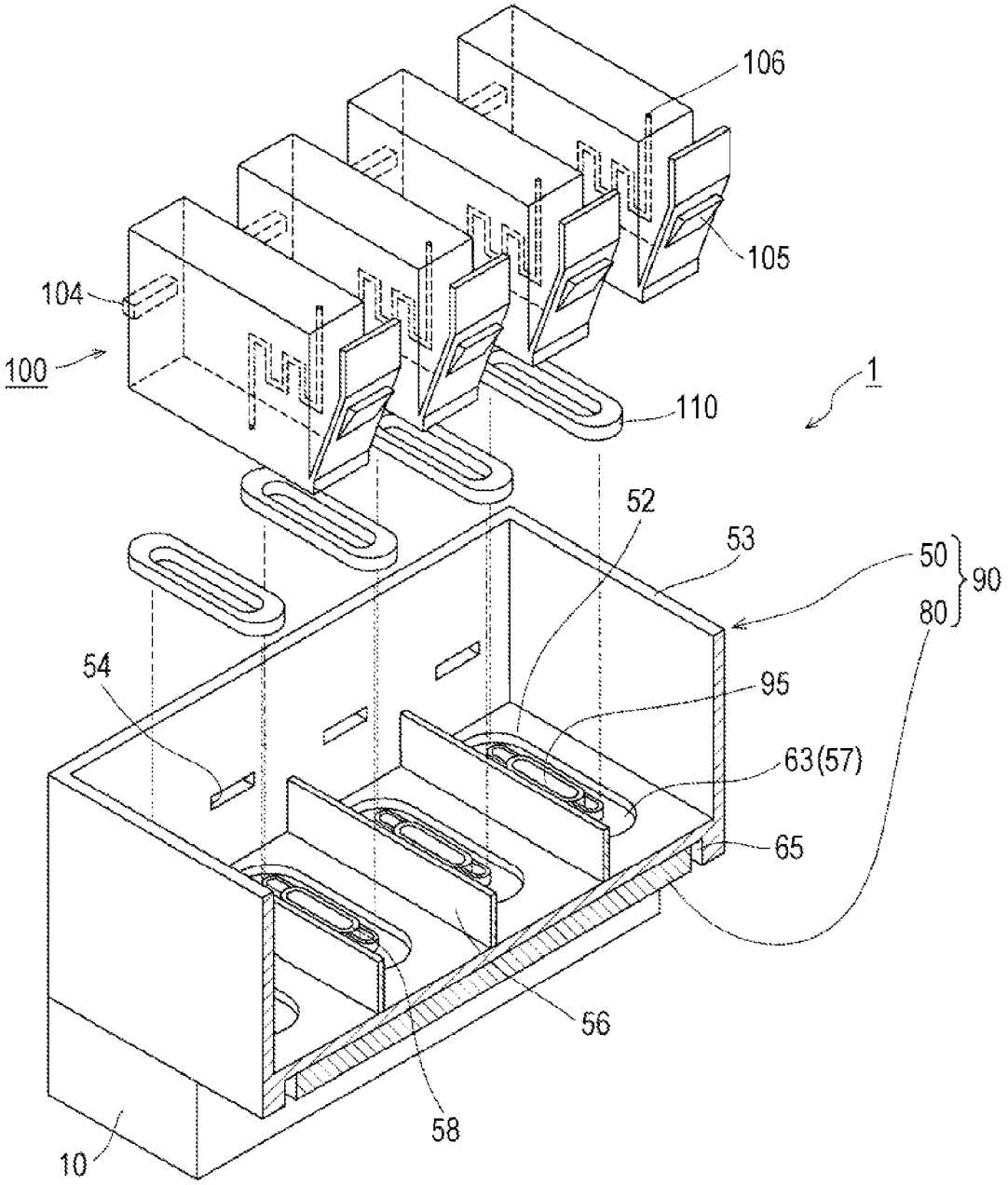
FIG. 1 is an exploded perspective view illustrating a head according to Embodiment 1.
Figure 2:
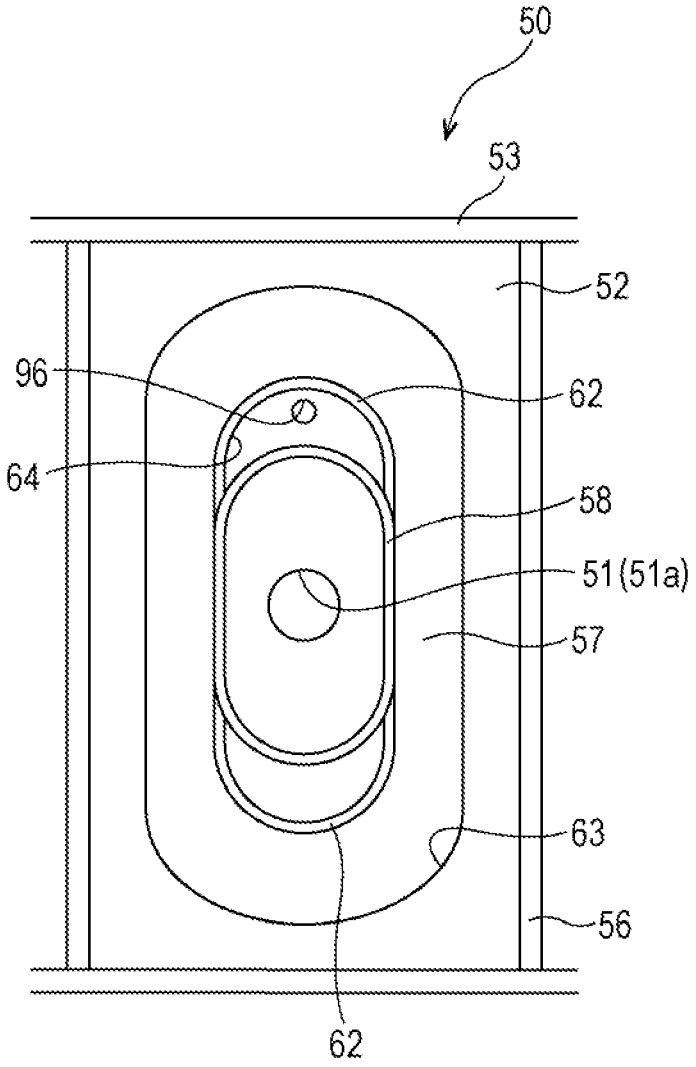
FIG. 2 is a top view illustrating a main portion of a flow channel member according to Embodiment 1.
Figure 3:
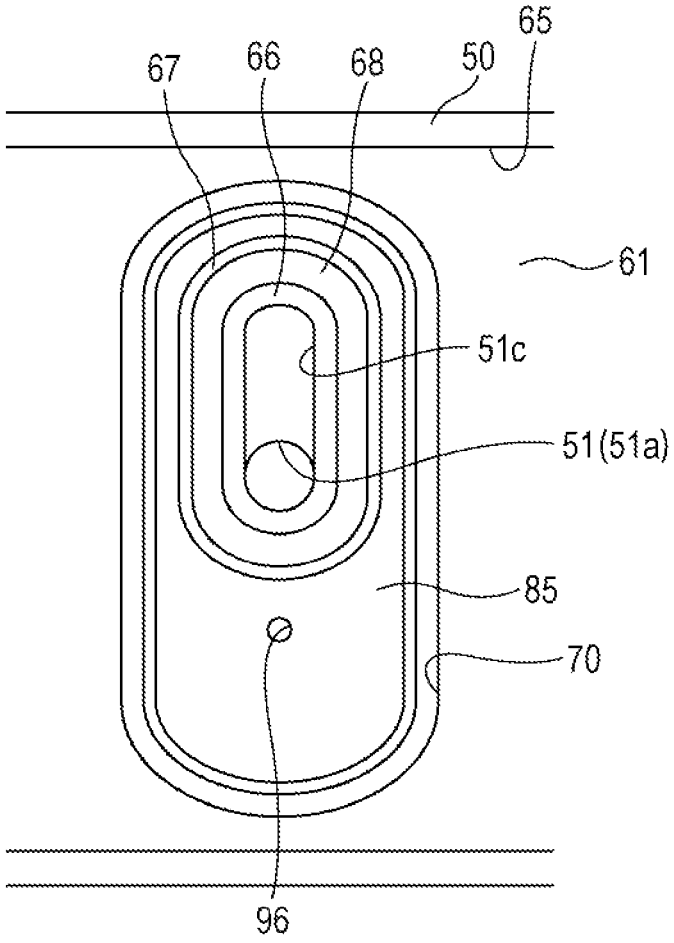
FIG. 3 is a bottom view illustrating the main portion of the flow channel member according to Embodiment 1.
Figure 4:
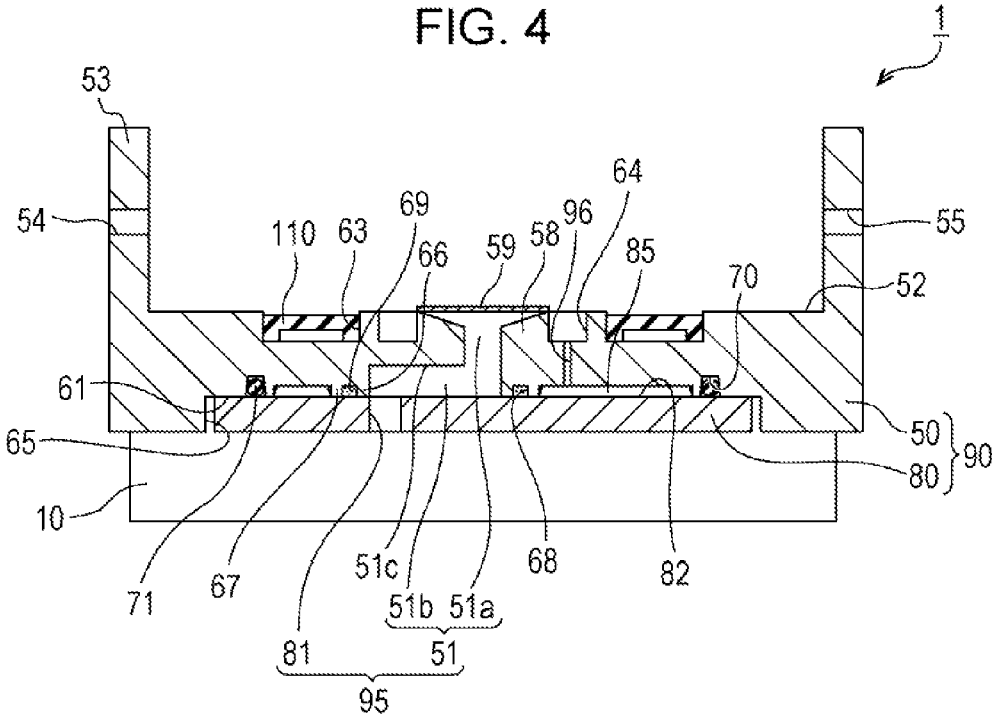
FIG. 4 is a cross-sectional view illustrating the flow channel member according to Embodiment 1.
Figure 5:
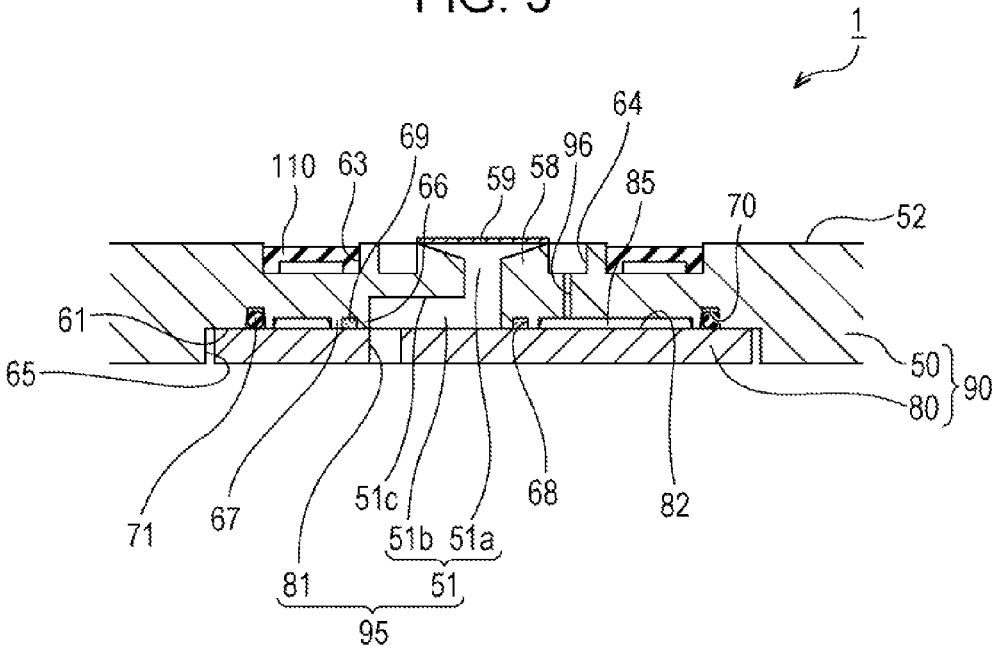
FIG. 5 is a cross-sectional view illustrating the main portion of the flow channel member according to Embodiment 1.

FIG. 1 is an exploded perspective view of a head according to the present embodiment, FIG. 2 is a top view illustrating a main portion of a flow channel member according to the embodiment, FIG. 3 is a bottom view illustrating the main portion of the flow channel member according to the embodiment, FIG. 4 is a cross-sectional view illustrating the flow channel member according to the embodiment, and FIG. 5 is a cross-sectional view illustrating the main portion of the flow channel member according to the embodiment.

As illustrated in FIG. 1, a head 1 includes a flow channel member 90 which an ink cartridge 100, a liquid storage unit storing an ink as a liquid, is attached to and detached from, and a head main body 10 fixed to the flow channel member 90.

The flow channel member 90 includes an attachment member 50 (a first member) having a first flow channel 51 to be connected to the ink cartridge 100, and a flow channel plate 80 (a second member) having a second flow channel 81 to be connected to the head main body 10, and is provided with a liquid flow channel 95 with which the first flow channel 51 and the second flow channel 81 communicate.

The attachment member 50 has a cartridge mounting unit 52 (an opposite side surface to the head main body 10) on which the ink cartridge 100 is mounted. In the embodiment, four ink cartridges 100 are mounted on the cartridge mounting unit 52.

The cartridge mounting unit 52 is configured such that the periphery thereof is surrounded by walls 53 where in a pair of mutually opposing wall surfaces of the walls 53, one wall surface has a first engagement hole 54 penetrating in the thickness direction. In addition, the other wall 53 opposing one wall 53 having the first engagement hole 54 has a second engagement hole 55 penetrating in the thickness direction. A first engagement hook 104 and a second engagement hook 105 of the ink cartridge 100 engage with the first engagement hole 54 and the second engagement hole 55.

The cartridge mounting unit 52 is provided with partitioning plates 56 partitioning a region on which four ink cartridges 100 are mounted. That is, in the cartridge mounting unit 52, four regions are formed by three partitioning plates 56.

As illustrated in FIGS. 2, 4 and 5, in each region of the cartridge mounting unit 52, which is partitioned by the partitioning plates 56, a first flow channel 51 is formed. The first flow channel 51 includes a vertical flow channel 51*a* penetrating the cartridge mounting unit 52 in the thickness direction (a stacking direction of the attachment member 50 and the flow channel plate 80) and a horizontal flow channel 51*b* communicating and being parallel with the vertical flow channel 51*a*.

Specifically, a recess 57 is disposed on a surface of the cartridge mounting unit 52. A cylindrical attachment portion 58 is disposed inside the recess 57. The vertical flow channel 51*a* is formed inside the attachment portion 58. A filter 59 is disposed so as to cross the vertical flow channel 51*a* in an opening on the attachment portion 58.

As illustrated in FIGS. 1, 4 and 5, the flow channel plate 80, an example of the second member, is a member with a flat plate shape and has the second flow channel 81 penetrating in the thickness direction.

Joining surfaces where the attachment member 50 and the flow channel plate 80 oppose each other are respectively referred to as a first joining surface 61 and a second joining surface 82. That is, a surface to which the flow channel plate 80 of the attachment member 50 is joined is the first joining surface 61, and a surface to which the attachment member 50 of the flow channel plate 80 is joined is the second joining surface 82.

Specifically, as illustrated in FIGS. 3, 4 and 5, an accommodation section 65 which is a recess accommodating the flow channel plate 80 is disposed in the attachment member 50. A surface to which the flow channel plate 80 of the accommodation section 65 is joined becomes the first joining surface 61.

A groove-shaped recess 51*c* continuous to the vertical flow channel 51*a* is formed on the first joining surface 61. If the flow channel plate 80 is joined to the first joining surface 61, the recess 51*c* is sealed and thereby the horizontal flow channel 51*b* is formed by the recess 51*c* and the flow channel plate 80. Then, if the first flow channel 51 (the horizontal flow channel 51*b*) communicates with the second flow channel 81 of the flow channel plate 80, which is located downstream, the liquid flow channel 95 is formed.

A first joining section and a second joining section are formed on the first joining surface 61 and the second joining surface 82, respectively. Here, the joining section represents a section where the first joining surface 61 and the second joining surface 82 are joined to each other.

The first joining section is arranged on the first joining surface 61 and the second joining surface 82, and encloses the first flow channel 51 and the second flow channel 81. In the embodiment, an adhesive 69 is used as the first joining section.

The second joining section is arranged on the first joining surface 61 and the second joining surface 82, and encloses the first joining section. In the embodiment, a seal member 71 is used as the second joining section.

Specifically, these adhesive 69 and seal member 71 are configured as follows.

As illustrated in FIGS. 3, 4 and 5, on the first joining surface 61 of the attachment member 50, a first annular boss portion 66 and a second annular boss portion 67 enclosing the outer side of the first boss portion 66 are disposed at an opening edge portion of the first flow channel 51 (the recess 51*c*). In the first boss portion 66 and the second boss portion 67, any one top surface comes into contact with the second joining surface 82 of the flow channel plate 80.

A lower bottom surface (a surface which does not come into contact with the second joining surface 82) located lower than the first boss portion 66 and the second boss portion 67 is disposed between the first boss portion 66 and the second boss portion 67. The bottom surface, the first boss portion 66 and the second boss portion 67 form a first annular groove 68.

The adhesive 69 is disposed inside the first groove 68, and the first joining surface 61 of the attachment member 50 and the second joining surface 82 of the flow channel plate 80 are adhered using the adhesive 69.

In this manner, the adhesive 69 (the first joining section) disposed in the first groove 68 is arranged between the first joining section 61 and the second joining section 82, and encloses openings of the first flow channel 51 (the recess 51*c*) and the second flow channel 81. Such disposing the adhesive 69 allows reliable sealing on a connecting surface between the first flow channel 51 and the second flow channel 81.

Furthermore, a second annular groove 70 enclosing the first groove 68 is disposed at the outer side of the first groove 68 on the first joining surface 61. The annular seal member 71 is fitted into the second groove 70. The seal member 71 (the second joining section) disposed in the second groove 70 in this manner is arranged between the first joining surface 61 and the second joining surface 82, and encloses the adhesive 69.

If the seal member 71 encloses the adhesive 69 in this manner, an air chamber 85 is formed between the first joining surface 61 and the second joining surface 82. That is, the air chamber 85 is a space formed between the adhesive 69 inside the first groove 68 and the seal member 71 inside the second groove 70, and is a space between the first joining surface 61 and the second joining surface 82.

In the embodiment, the first groove 68 and the second groove 70 are formed, and then the adhesive 69 and the seal member 71 are respectively arranged. However, the first groove 68 and the second groove 70 may not necessarily be formed. That is, the air chamber 85 may be directly formed using the adhesive 69 and the seal member 71.

On the other hand, a communication channel 96 penetrating in the thickness direction is disposed at the attachment member 50. The communication channel 96 allows the air chamber 85 to communicate outward. Specifically, the communication channel 96 is formed at the attachment member 50 by forming a through-hole so as to communicate with the air chamber 85. The air chamber 85 is open to the outside atmosphere. Details of a configuration where the air chamber 85 is open to the atmosphere and operation effect will be described later.

Further, it is preferable that the adhesive 69 (the first joining section) have a higher air permeability or vapor permeability than any one among the seal member 71 (the second joining section), the attachment member 50 (the first member) and the flow channel plate 80 (the second member). Here, the air permeability means a property which allows the gas to permeate, but does not allow the liquid to permeate. In addition, the vapor permeability means a property which allows the vapor to permeate which is evaporated from moisture components and others of the ink (the liquid) flowing in the liquid flow channel 95.

In general, the adhesive with ink resistance has the high air permeability and high vapor permeability. One with such a property is used as the adhesive 69, whereas the other one with the lower air permeability and vapor permeability than the adhesive 69 is used as the seal member 71, the attachment member 50 and the flow channel plate 80. In case of this configuration, the adhesive 69 allows reliable ink resistance such that the ink does not leak out from the liquid flow channel 95, and using the seal member 71 enables the vapor permeability to be suppressed.

Figure 6:
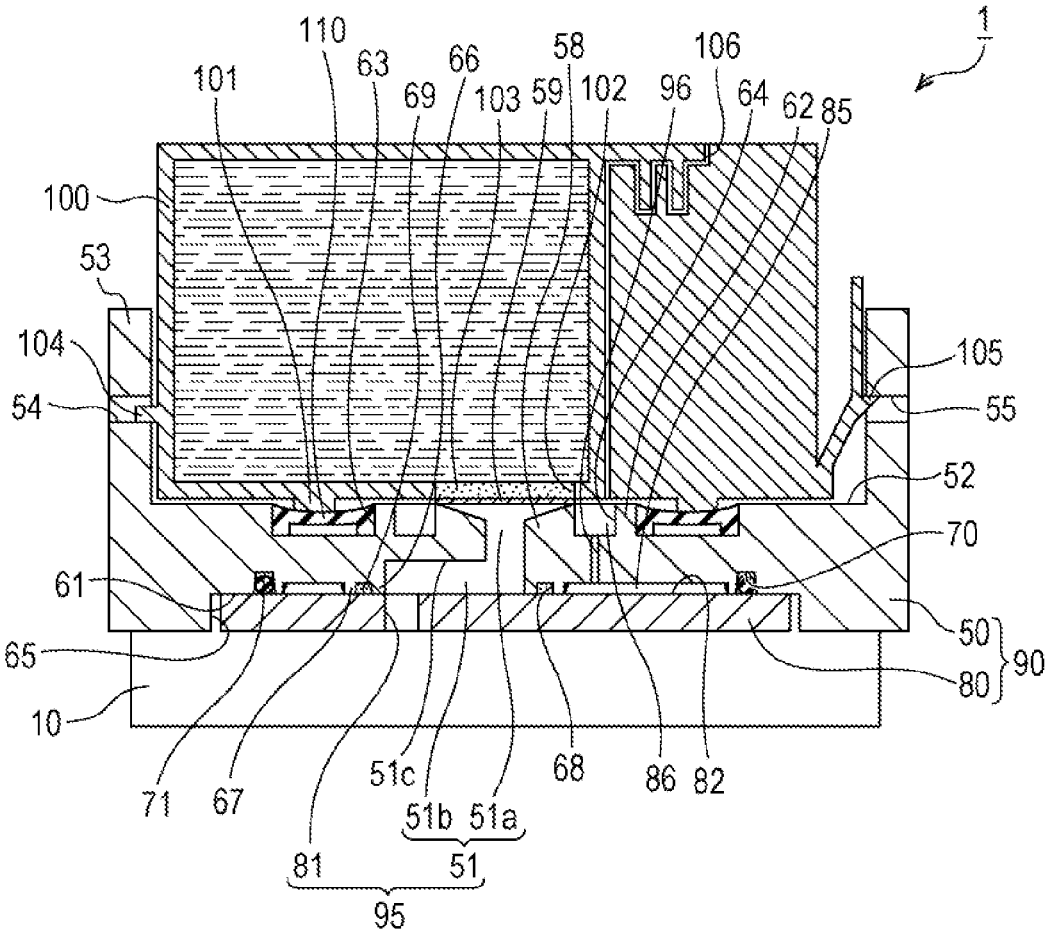
FIG. 6 is a cross-sectional view illustrating the head according to Embodiment 1.

FIG. 6 is a cross-sectional view illustrating the head to which the ink cartridge is attached. As illustrated in FIG. 6, the ink cartridge 100 is attached to the flow channel member 90.

The ink cartridge 100 has a hollow box shape, and inside thereof, stores the ink (the liquid) to be supplied to the head main body 10. A rib 101 with a cylindrical shape is disposed on the bottom surface of the ink cartridge 100, and a supply port 102 supplying the ink inside the ink cartridge 100 to the flow channel member 90 is disposed at the inner side of the rib 101. A supply portion 103 is disposed inside the supply port 102. The supply portion 103 comes into pressurizing contact with the filter 59 of the flow channel member 90, and supplies the ink inside the ink cartridge 100 to the liquid flow channel 95 of the flow channel member 90. As such a supply portion 103, it is possible to use, for example, porous materials or non-woven fabric such as cotton-like pulp, macromolecule absorbing polymer and urethane foam.

In addition, the ink cartridge 100 has the first engagement hook 104 to be inserted to the first engagement hole 54 disposed on the wall 53 of the attachment member 50, and the second engagement hook 105 which is disposed at the opposite surface side to the first engagement hook 104 and to be inserted to the second engagement hole 55 on the wall 53 disposed on the wall 53 of the attachment member 50.

The second engagement hook 105 is integrally formed with the ink cartridge 100 such that one end portion is fixed to the supply portion 103 side of a side surface of the ink cartridge 100 and the other end portion becomes a free end. In this manner, the second engagement hook 105 is elastically deformable toward the side surface of the ink cartridge 100.

The ink cartridge 100 is attached to the attachment member 50 in the following manner. At first, the first engagement hook 104 side of the ink cartridge 100 is first obliquely inserted into the wall 53 of the attachment member 50 and then the first engagement hook 104 is inserted to the first engagement hole 54. Next, in a state where the first engagement hook 104 of the ink cartridge 100 is inserted to the first engagement hole 54, the ink cartridge 100 is rotated as a fulcrum of the first engagement hook 104. In this manner, the ink cartridge 100 is inserted into the wall 53. Then, the ink cartridge 100 is fixed to the cartridge mounting unit 52 of the flow channel member 90 by bringing the second engagement hook 105 into contact with the second engagement hole 55. Detaching the ink cartridge 100 from the second engagement hole 55 is performed by elastically deforming the second engagement hook 105 to the ink cartridge 100 side.

The filter 59 covering the liquid flow channel 95 (the first flow channel 51) is disposed at the attachment portion 58 to which the ink cartridge 100 is connected. The filter 59 is intended to remove foreign substances or air bubbles contained in the ink. For example, it is possible to use a sheet-like one where a plurality of micro-pores is formed by finely knitted metal or resin fibers, or one where a plurality of micro-pore is allowed to penetrate a sheet-like metal or resin member and the like. Further, non-woven fabric may be used as the filter 59, and the material used for the filter is not particularly limited.

In addition, as illustrated in FIGS. 2, 5 and 6, a diaphragm 62 dividing the recess 57 is disposed at the outer side of the attachment portion 58. Within the recess 57, an outer side recess divided by the diaphragm 62 is referred to as a groove for sealing 63 and an inner side recess divided by the diaphragm 62 is referred to as a groove for releasing atmosphere 64. An annular elastic member 110 is attached to the groove for sealing 63. Further, above-described communication channel 96 is open in the groove for releasing atmosphere 64.

Figure 7:
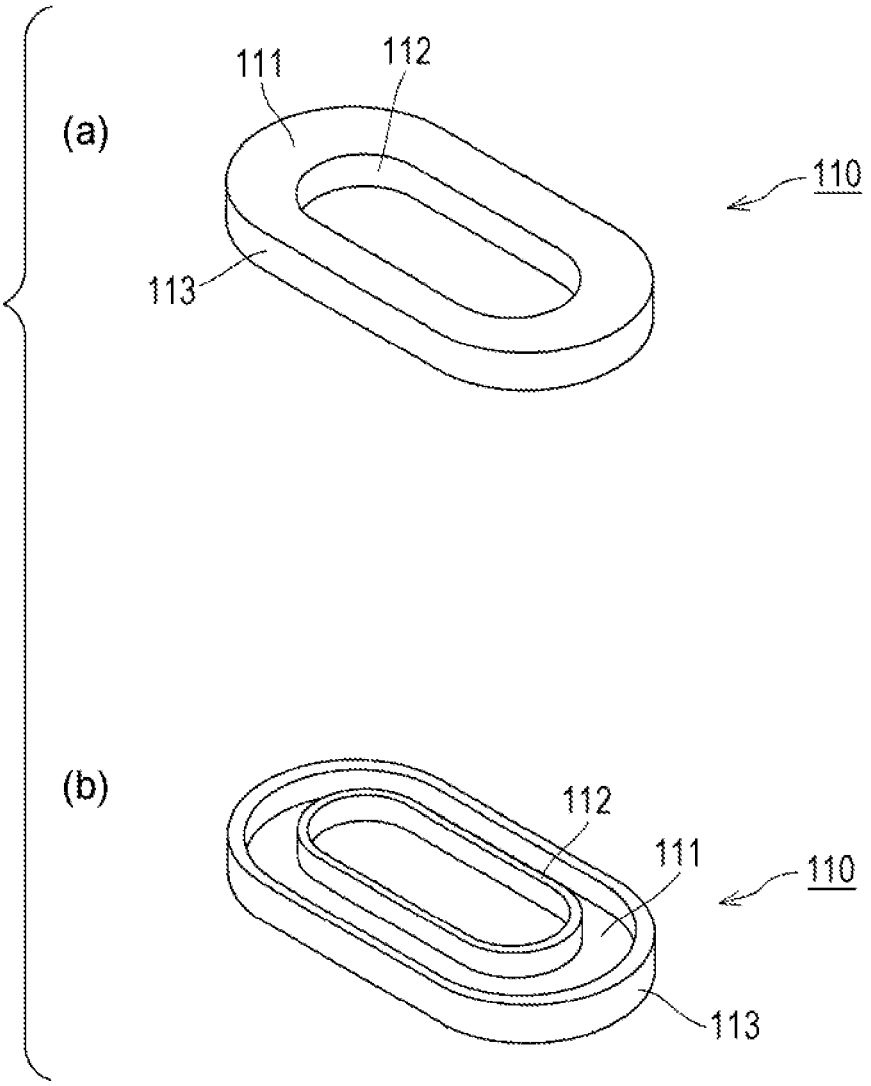
FIG. 7 is a perspective view illustrating an elastic member according to Embodiment 1.

FIG. 7 is a perspective view illustrating an elastic member. The elastic member 110 is formed from elastic materials such as rubber and elastomer, and the cross-sectional shape thereof has a C-shape opening to the bottom side of the groove for sealing 63.

Specifically, in the elastic member 110, a second elastic portion 112 with a cylindrical shape is connected to the inner peripheral side of a first elastic portion 111 formed in a flat plate shape and an annular shape. In addition, a third elastic portion 113 with a cylindrical shape is connected to the outer peripheral side of the first elastic portion 111. Then, the inner diameter of the second elastic portion 112 is sized for being in substantially close contact with the outer periphery of the attachment portion 58 and the diaphragm 62. In addition, the inner diameter of the third elastic portion 113 is sized for being in substantially close contact with the inner periphery of the recess 57.

As illustrated in FIG. 6, the elastic member 110 is attached to the groove for sealing 63 so as to accommodate the attachment portion 58 at the inner side of the second elastic portion 112 (refer to FIG. 7). On the other hand, the rib 101 disposed in the ink cartridge 100 is annularly disposed opposing the elastic member 110, and the supply portion 103 is located inside thereof.

In the ink cartridge 100 attached to the attachment member 50, the supply portion 103 is in pressurizing contact with the filter 59. In this manner, the supply port 102 of the ink cartridge 100 and the first flow channel 51 (the liquid flow channel 95) communicate with each other, and thereby the ink can be supplied from the ink cartridge 100 to the liquid flow channel 95. In addition, the rib 101 is in pressurizing contact with the elastic member 110. In such a manner that the elastic member 110 is elastically deformed, the reaction force improves airtightness between the rib 101 and the elastic member 110 and ensures a sealing property between the supply portion 103 and the first flow channel 51.

Figure 8:
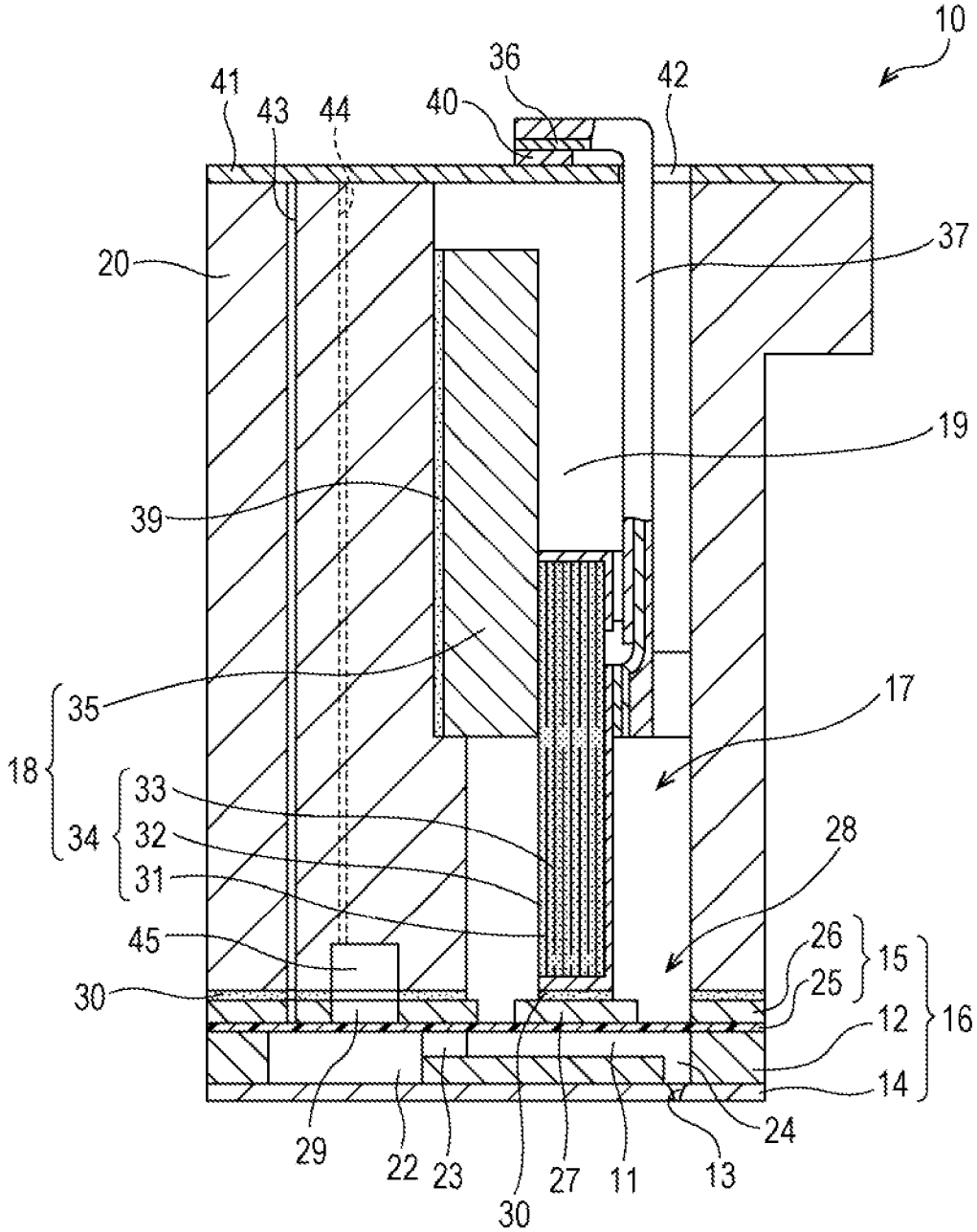
FIG. 8 is a cross-sectional view illustrating a head main body according Embodiment 1.

The head main body 10 to which the ink is supplied by the ink cartridge 100 and the flow channel member 90 will be described. FIG. 8 is a cross-sectional view of the head main body according to the embodiment.

The head main body 10 includes a flow channel formation substrate 12 which is an example of a flow channel substrate having a plurality of pressure generation chambers 11, a nozzle plate 14 where a plurality of nozzles 13 communicating with each of the pressure generation chambers 11 is drilled, and a flow channel unit 16 provided with a vibrating plate 15 disposed on the opposite side surface to the nozzle plate 14 of the flow channel formation substrate 12. The head main body 10 further includes a piezoelectric element unit 18 having a piezoelectric element 17 disposed in a region corresponding to each of the pressure generation chambers 11 on the vibrating plate 15, and a case head 20 having an accommodation section 19 which is fixed onto the vibrating plate 15 and accommodates the piezoelectric element unit 18.

In the flow channel formation substrate 12, on a surface layer portion of one surface side thereof, the pressure generation chambers 11 are divided by diaphragms and juxtaposed in the width direction thereof in plural numbers. In the outer side of each row of the pressure generation chambers 11, a manifold 22 to which the ink is supplied via an ink introduction channel 43 disposed at the case head 20 is disposed by penetrating the flow channel formation substrate 12 in the thickness direction. Then, the manifold 22 and each of the pressure generation chambers 11 communicate with each other via an ink supply channel 23, and the ink is supplied to each of the pressure generation chambers 11 via the ink introduction channel 43, the manifold 22 and the ink supply channel 23. In addition, at the opposite end portion side to the manifold 22 of the pressure generation chambers 11, a nozzle communication hole 24 penetrating the flow channel formation substrate 12 is formed. In the embodiment, the flow channel formation substrate 12 is configured to have a single crystal silicon substrate, and the above-described pressure generation chambers 11 disposed on the flow channel formation substrate 12 are formed by etching the flow channel formation substrate 12.

The nozzle plate 14 in which nozzles 13 are drilled is joined to one surface side of the flow channel formation substrate 12, and each of the nozzles 13 communicates with each of the pressure generation chambers 11 via the nozzle communication hole 24 disposed on the flow channel formation substrate 12.

In addition, the vibrating plate 15 is joined to the other surface side of the flow channel formation substrate 12, that is, the opening surface side of the pressure generation chambers 11, and each of the pressure generation chambers 11 is sealed by the vibrating plate 15.

For example, the vibrating plate 15 is formed to have an elastic film 25 formed from an elastic member such as a resin film and a composite plate with a support plate 26 formed from metal such as SUS, for example, which supports the elastic film 25, and the elastic film 25 side is joined to the flow channel formation substrate 12.

In addition, within a region opposing each of the pressure generation chambers 11 of the vibrating plate 15, an island 27 with which a distal end of the piezoelectric element 17 comes into contact is disposed. A distal end surface of the piezoelectric element 17 is joined to the island 27 using the adhesive 30. That is, a thin wall portion 28 having a thinner thickness than other regions is formed in a region opposing the peripheral portion of each of the pressure generation chambers 11 of the vibrating plate 15, and each island 27 is disposed at the inner side of the thin wall portion 28. In addition, in the embodiment, in a region opposing the manifold 22 of the vibrating plate 15, similarly to the thinner wall portion 28, the support plate 26 is removed by etching to dispose a compliance portion 29 configured to substantially have an elastic film only. Further, the compliance portion 29, when a pressure change occurs inside the manifold 22, absorbs the pressure change by deforming the elastic film 25 of the compliance portion 29, and serves to usually maintain a constant pressure inside the manifold 22.

The piezoelectric element 17 is integrally formed in one piezoelectric element unit 18. That is, each piezoelectric element 17 is formed in such a manner that a piezoelectric element formation member 34 is formed in which a piezoelectric material 31, electrode formation materials 32 and 33 are longitudinally and alternately pinched in a sandwich shape and stacked, and then the piezoelectric element formation member 34 is cut and divided to have a comb-like shape corresponding to each of the pressure generation chambers 11. In other words, a plurality of piezoelectric elements 17 is integrally formed. Then, an inactive region which does not contribute to vibrations of the piezoelectric elements 17 (the piezoelectric element formation member 34), that is, a base end side of the piezoelectric elements 17 is firmly fixed to a fixed substrate 35, and the piezoelectric elements 17 are fixed to the case head 20 via the fixed substrate 35.

In addition, in the vicinity of the base end side of the piezoelectric elements 17, a flexible wiring substrate 37 supplying signals for driving each of the piezoelectric elements 17 is connected to an opposite side surface to the fixed substrate 35, and the piezoelectric elements 17 (the piezoelectric element formation member 34), the fixed substrate 35 and the flexible wiring substrate 37 configure the piezoelectric element unit 18.

The accommodation section 19 penetrating in the thickness direction in a region relatively opposing the island 27 is disposed in the case head 20. The entire piezoelectric element units 18 are accommodated in the accommodation section 19. As described above, the distal end of the piezoelectric elements 17 comes into contact with the island 27 of the vibrating plate 15 to be fixed thereto, and the fixed substrate 35 is fixed to the case head 20 using the adhesive 39.

A wiring substrate 41 having a plurality of conductive pads 40 to which each wiring 36 of the flexible wiring substrate 37 is individually connected is fixed onto the case head 20, and the accommodation section 19 of the case head 20 is substantially closed by the wiring substrate 41. In the wiring substrate 41, an opening 42 with a slit shape is formed in a region opposing the accommodation section 19 of the case head 20, and the flexible wiring substrate 37 is drawn outward of the accommodation section 19 from the opening 42 of the wiring substrate 41.

For example, the flexible wiring substrate 37 is configured to have a chip on film (COF) on which a drive IC (not illustrated) for driving the piezoelectric elements 17 is mounted. Then, each wiring 36 of the flexible wiring substrate 37 is connected to the corresponding electrode formation materials 32 and 33 configuring the piezoelectric elements 17, at the base end side, using solder, anisotropic conductive material or the like, for example. On the other hand, each wiring 36 is joined to each of the conductive pads 40 of the wiring substrate 41, at the distal end side. Specifically, in a state where the distal end of the flexible wiring substrate 37, which is drawn outward of the accommodation section 19 from the opening 42 of the wiring substrate 41, is bent along the surface of the wiring substrate 41, each wiring 36 is joined to each of the conductive pads 40 of the wiring substrate 41.

The head main body 10 as described above is attached to the flow channel member 90 (refer to FIGS. 1 and 4), and the ink introduction channel 43 is connected to the liquid flow channel 95. That is, the ink is supplied to the manifold 22 from the ink cartridge 100 via the liquid flow channel 95 of the flow channel member 90 and the ink introduction channel 43. Then, in the head main body 10, the ink is distributed to each of the pressure generation chambers 11 via the ink supply channel 23. In fact, applying a voltage to the piezoelectric elements 17 causes the piezoelectric elements 17 to contract. In this manner, the vibrating plate 15 is deformed along with the piezoelectric elements 17 so as to expand a volume in each of the pressure generation chambers 11, and thereby the ink is drawn into the pressure generation chambers 11. After the inside including the nozzles 13 is filled with the ink, the voltage applied to the electrode formation materials 32 and 33 of the piezoelectric elements 17 is released according to recording signals supplied via the wiring substrate 41. In this manner, the piezoelectric elements 17 are stretched to return to their original state, and the vibrating plate 15 is also deformed to return to its original state. As a result, the volume in the pressure generation chambers 11 contracts to increase the pressure inside the pressure generation chambers 11, and thereby ink droplets are ejected from the nozzles 13.

In addition, a compliance space 45 is disposed in a region opposing the compliance portion 29 of the case head 20. The compliance space 45 communicates with a connection channel 44 which is a through hole disposed at the case head 20. Then, the connection channel 44 communicates outward via a gap between the head main body 10 and the attachment member 50.

In this manner, since the compliance space 45 communicates outward, it is possible for the compliance portion 29 to be deformed well corresponding to a pressure change in the manifold 22.

Here, with reference to FIG. 6, a configuration will be described in detail where the air chamber 85 defined in the flow channel member 90 is allowed to communicate outward via the communication channel 96.

A pressure adjustment section is disposed in the ink cartridge 100. The pressure adjustment section is a section having a function of adjusting a pressure in the air chamber 85. More specifically, the section communicates with the air chamber 85 to release the air in the air chamber 85 outward, adjusts the pressure inside the air chamber 85 to an atmospheric pressure, and has a diffusion resistance to the air.

In the embodiment, as an example of the pressure adjustment section, an outward open channel 106 is disposed inside the ink cartridge 100.

One opening of the outward open channel 106 is disposed at a position opposing the groove for releasing atmosphere 64 of the flow channel member 90, and the other opening is disposed on the upper surface side of the ink cartridge 100 (the opposite side to the cartridge mounting unit 52). That is, the outward open channel 106 communicates with a space 86 (a space located inward from the joining surface between the rib 101 and the elastic member 110, between the ink cartridge 100 and the attachment member 50) formed in such a manner that the rib 101 and the elastic member 110 are in pressurizing contact with each other, and allows the space 86 to be connected outward.

In addition, the outward open channel 106 is formed to be elongated and partially meandering. Since the outward open channel 106 is shaped like this, it is possible to increase the diffusion resistance to the air circulating in the outward open channel 106. It is possible to optionally set the pressure in the air chamber 85 by adjusting the shape of the outward open channel 106 and appropriately setting the diffusion resistance. Further, the outward open channel 106 does not need the pressure adjustment section, but may be a flow channel allowing the air chamber 85 to communicate outward.

If the ink cartridge 100 is attached to the attachment member 50 in this manner, the outward open channel 106 communicates with the communication channel 96 which is open in the groove for releasing atmosphere 64 of the flow channel member 90. That is, the air chamber 85 communicates outward via the communication channel 96, the groove for releasing atmosphere 64 and the outward open channel 106 in this order.

In this manner, in the head 1 according to the embodiment, the air chamber 85 communicates outward via the communication channel 96 and the outward open channel 106, and the internal pressure thereof is adjustable. Therefore, it is possible to maintain a constant pressure by suppressing that temperature changes causes the inside of the air chamber 85 to have an extremely higher pressure or lower pressure as compared to the atmospheric pressure. Accordingly, it is possible to suppress infiltration of the air inside the air chamber 85 into the adhesive 69, which results from a higher pressure than the outside, and to suppress permeation of the air into the liquid flow channel 95.

In this manner, since the ink inside the liquid flow channel 95 does not allow the air to be mixed from the air chamber 85, it is possible to suppress poor ink ejection by suppressing mixed bubbles in the ink. As the flow channel member 90 according to the embodiment, it is possible to supply the ink to other members (in the embodiment, the head main body 10) without allowing the air to be mixed into the liquid flow channel 95 formed from a plurality of members from the air chamber 85 formed on the joining surface of the members.

In addition, in the head 1 according to the embodiment, the outward open channel 106 is disposed in the ink cartridge 100. Accordingly, it is not necessary to dispose a very long flow channel corresponding to the outward open channel 106, at the flow channel member 90 side, and thereby it is possible to decrease the flow channel member 90 in size. Since as the flow channel member 90 according to the embodiment, a flow channel (corresponding to the outward open channel 106) is not disposed for the gas discharged from other members (in the embodiment, the head main body 10), it is possible to decrease the size that much.

Furthermore, the flow channel member 90 is configured such that the liquid flow channel 95 partially has the vertical flow channel 51*a* and the horizontal flow channel 51*b*. That is, it is possible to receive the ink from the supply portion 103 of the ink cartridge 100 using the vertical flow channel 51*a*, to circulate the ink in any horizontal direction using the horizontal flow channel 51*b*, and to supply the ink to the head main body 10 via the second flow channel 81. Accordingly, regardless of a position (in the embodiment, a position of the attachment portion 58) connected by the supply portion 103 of the ink cartridge 100, it is possible to attach the head main body 10 to the flow channel member 90 at any position.

In addition, since the horizontal flow channel 51*b* is disposed between the attachment member 50 and the flow channel plate 80, it is possible to reduce the thickness of the flow channel member 90. If a liquid flow channel is disposed at an integrated flow channel member, in order to circulate the ink in any horizontal direction from the attachment portion 58 to which the supply portion 103 of the ink cartridge 100 is connected, the liquid flow channel is required to be tilted with respect to the thickness direction of the flow channel member. However, in this case, the thickness of the flow channel member is increased as much as a tilted amount of the liquid flow channel.

On the other hand, since the liquid flow channel 95 has the horizontal flow channel 51*b*, it is possible to decrease the length of the liquid flow channel 95 in the thickness direction, and thereby it is possible to decrease the size of the head 1 and the flow channel member 90 according to the embodiment in the thickness direction.

Embodiment 2

In Embodiment 1, the outward open channel 106 is formed in each ink cartridge 100 and each outward open channel 106 is allowed to communicate with the air chamber 85 formed around each liquid flow channel 95. In Embodiment 2, a head 1A will be described in which without forming the air chamber 85 for each liquid flow channel 95, there is provided a flow channel member 90A allowing the air chamber 85 to communicate with the outward open channel 106 disposed in one ink cartridge 100 by setting the air chamber 85 to be shared with a plurality of the liquid flow channels 95.

Figure 9:
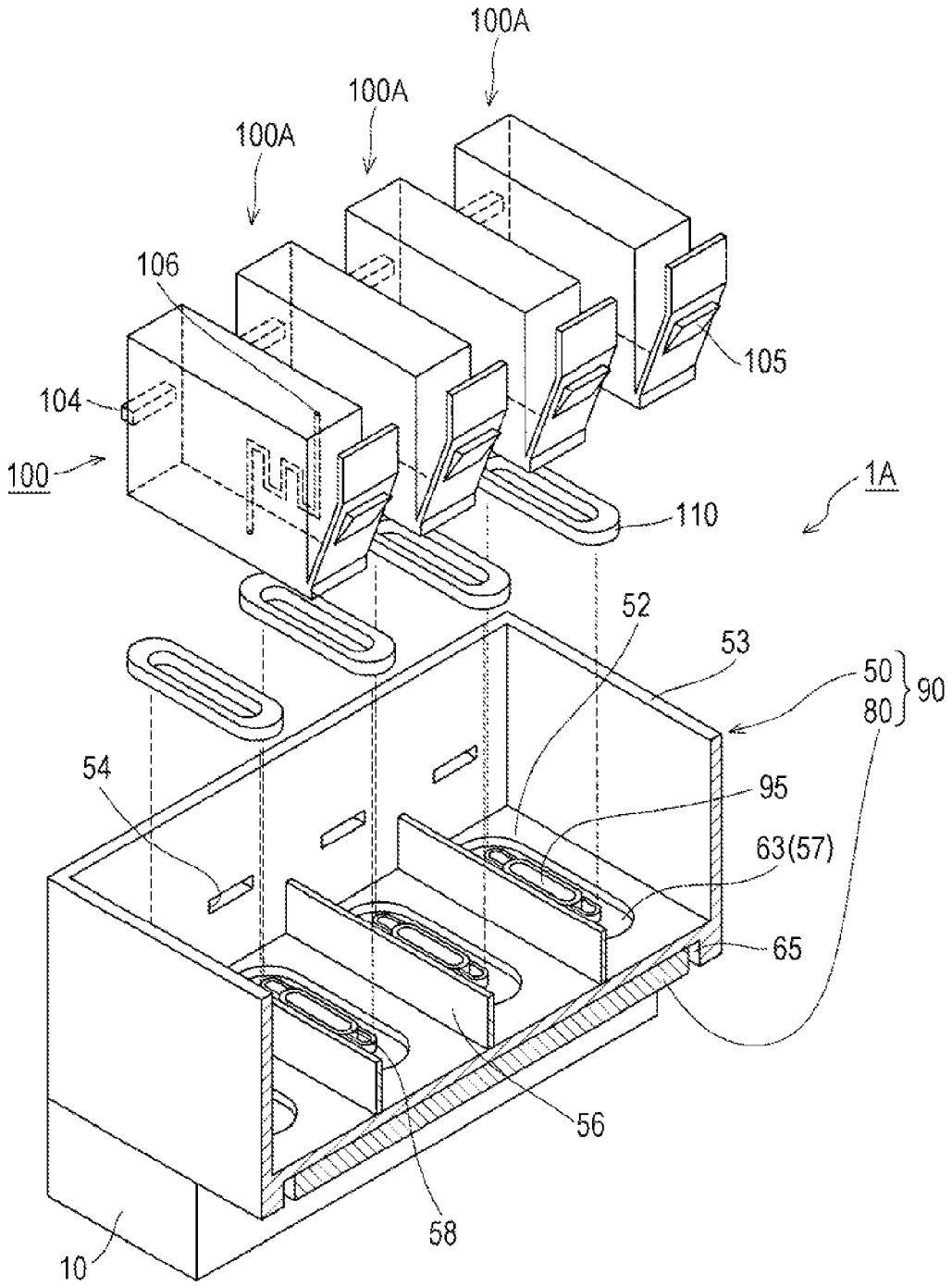
FIG. 9 is an exploded perspective view illustrating a head according to Embodiment 2.
Figure 10:
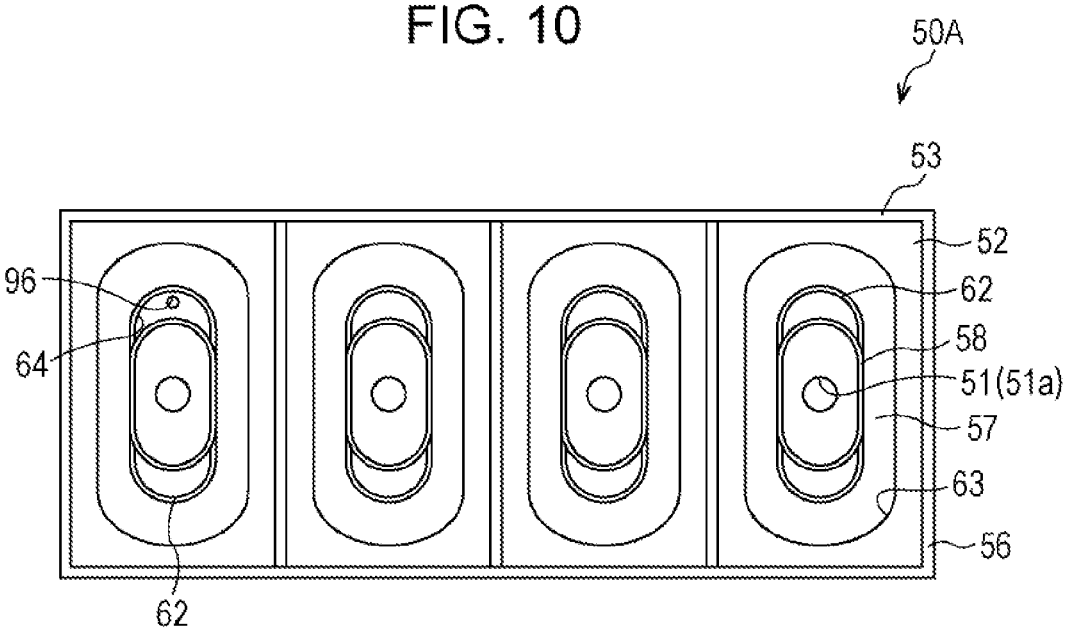
FIG. 10 is a top view illustrating a flow channel member according to Embodiment 2.
Figure 11:
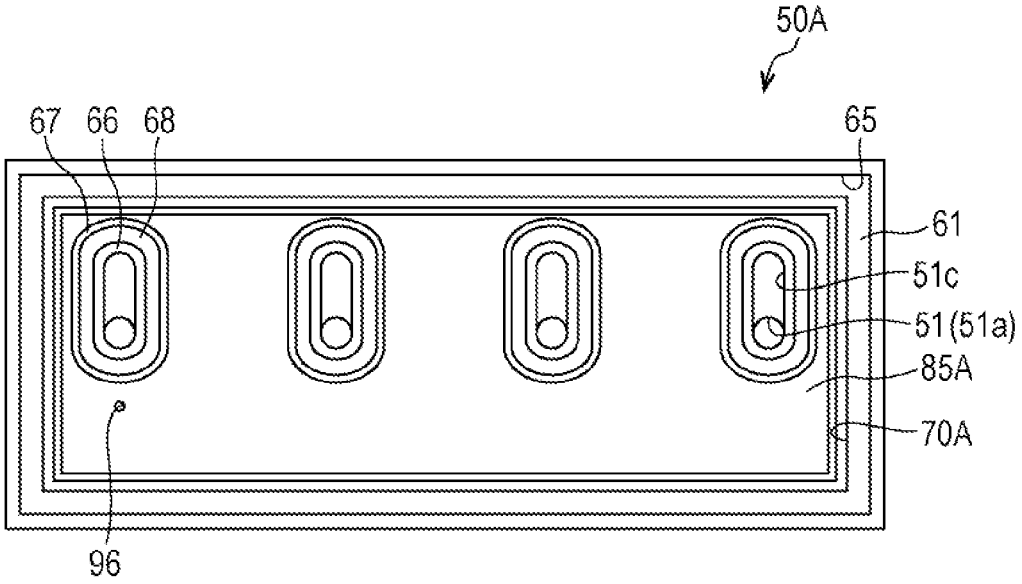
FIG. 11 is a bottom view illustrating the flow channel member according to Embodiment 2.
Figure 12:
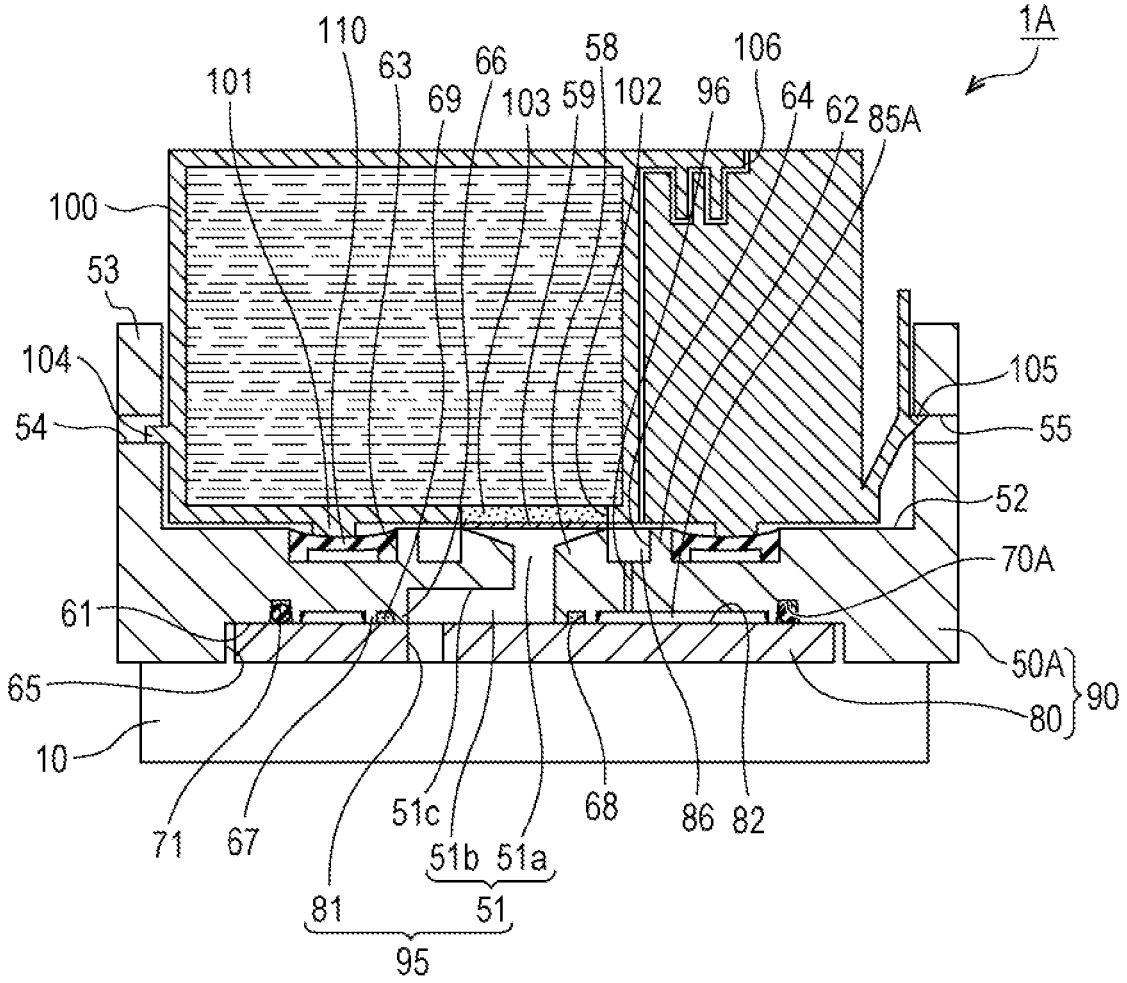
FIG. 12 is a cross-sectional view illustrating the head according to Embodiment 2.

FIG. 9 is an exploded perspective view of a head according to the present embodiment, FIG. 10 is a top view illustrating a flow channel member according to the embodiment, FIG. 11 is a bottom view illustrating the flow channel member according to the embodiment, and FIG. 12 is a cross-section view of the head according to the embodiment. Further, the same reference numerals are given to the same elements as those in Embodiment 1, and the repeated description will be omitted.

As illustrated in FIG. 9, one ink cartridge 100 and three ink cartridges 100A are attached to the attachment member 50. The ink cartridge 100A has the same configuration as the ink cartridge 100 except that the outward open channel 106 is not disposed. That is, the outward open channel 106 is disposed in one ink cartridge 100 only among four.

As illustrated in FIG. 10, the communication channel 96 is disposed at the attachment member 50. The communication channel 96 is open inside the groove for releasing atmosphere 64 of the attachment portion 58 to which the ink cartridge 100 is attached.

On the other hand, with regard to three attachment portions 58 to which the ink cartridge 100A is attached, the communication channel 96 is not open inside the groove for releasing atmosphere 64.

As illustrated in FIGS. 11 and 12, four first grooves 68 formed from the first boss portion 66 and the second boss portion 67 are formed for each of the first flow channels 51 (the recess 51*c*) on the first joining surface 61 of the attachment member 50. The adhesive 69 (the first joining section) is disposed at the first grooves 68, similarly to Embodiment 1. That is, the adhesive 69 is formed so as to enclose the first flow channel 51 and the second flow channel 81.

Then, one air chamber 85A is formed by allowing the air chambers around the first joining section, which correspond to each color of the ink, to communicate with each other. On the other hand, a second groove 70A is formed to enclose all of the first groove 68 and the air chamber 85A on the first joining surface 61. A seal member 71 (the second joining portion) is disposed at the second groove 70A. That is, the seal member 71 is formed to enclose each adhesive 69.

The flow channel plate 80 having the second joining surface 82 is joined to the first joining surface 61 where the adhesive 69 is disposed at the first groove 68 and the seal member 71 is disposed at the second groove 70A. In this manner, one air chamber 85A is formed outside the adhesive 69, that is, inside the seal member 71, between the attachment member 50 and the flow channel plate 80.

In addition, on the first joining surface 61 of the attachment member 50, the communication channel 96 is open outside the adhesive 69, that is, inside the seal member 71. Therefore, the air chamber 85A communicates outward via the communication channel 96 and the outward open channel 106 of the ink cartridge 100.

As described above, in a head 1A according to the embodiment, one common air chamber 85A is formed around each liquid flow channel 95. Since even the air chamber 85A of this aspect communicates outward similarly to Embodiment 1, the inner pressure thereof is adjustable. Therefore, it is possible to maintain a constant pressure by suppressing that temperature changes causes the inside of the air chamber 85A to have an extremely higher pressure or lower pressure as compared to the atmospheric pressure. Accordingly, it is possible to suppress infiltration of the air inside the air chamber 85A into the adhesive 69, which results from a higher pressure than the outside, and to suppress permeation of the air into the liquid flow channel 95.

In this manner, since the ink inside the liquid flow channel 95 does not allow the air to be mixed from the air chamber 85A, it is possible to suppress poor ink ejection by suppressing mixed bubbles in the ink. As the flow channel member 90 according to the embodiment, it is possible to supply the ink to other members (in the embodiment, the head main body 10) without allowing the air to be mixed into the liquid flow channel 95 formed from a plurality of members from the air chamber 85A formed on the joining surface of the members.

In addition, since the common air chamber 85A is formed around each liquid flow channel 95, it is possible to have a simpler structure compared to a case where the air chamber is formed for each liquid flow channel 95, and thereby it is possible to reduce labors and costs required for processing and the like.

Embodiment 3

In Embodiment 1, the compliance space 45 of the head main body 10 is open outward via the connection channel 44 (refer to FIG. 8). In Embodiment 3, a head 1B will be described in which the compliance space 45 communicates with the air chamber 85.

Figure 13:
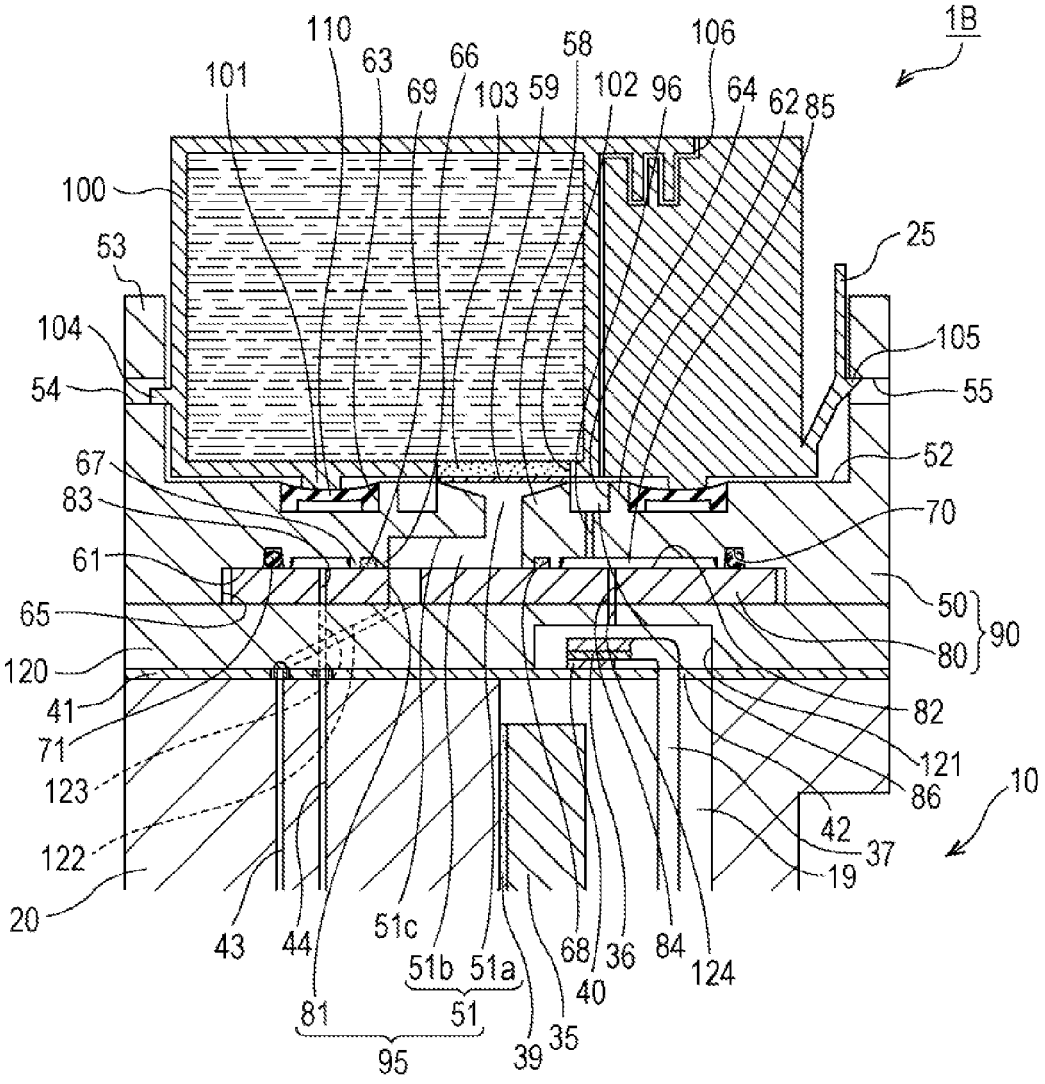
FIG. 13 is a cross-sectional view illustrating a head according to Embodiment 3.

FIG. 13 is a cross-sectional view of the head according to the present embodiment. Further, the same reference numerals are given to the same elements as those of Embodiment 1, and the repeated description will be omitted.

The head 1B includes the flow channel member 90, a flow channel plate 120 and the head main body 10. The flow channel plate 120 is a member joining the flow channel member 90 and the head main body 10, by being arranged therebetween.

The wiring substrate 41 of the head main body 10 is joined to a surface of the head main body 10 side of the flow channel plate 120. In addition, the conductive pad 40 disposed at the wiring substrate 41 and a recess 121 accommodating the wiring 36 connected to the conductive pad 40 is formed on the surface.

The flow channel plate 120 has a liquid flow channel 122. The liquid flow channel 122 is a through hole which is open in both surfaces of the flow channel plate 120, in which one opening communicates with the liquid flow channel 95 (the second flow channel 81) and the other opening communicates with the ink introduction channel 43 of the head main body 10. That is, the ink is configured to be supplied from the liquid flow channel 95 to the manifold 22 (refer to FIG. 8) via the liquid flow channel 122 and the ink introduction channel 43.

In addition, a first atmosphere open channel 83 is disposed at the flow channel plate 80 and a second atmosphere open channel 123 is disposed at the flow channel plate 120. The first atmosphere open channel 83 is a through hole which is open in both surfaces of the flow channel plate 80, and the second atmosphere open channel 123 is a through hole which is open in both surfaces of the flow channel plate 120.

One opening of the first atmosphere open channel 83 communicates with the air chamber 85, and one opening of the second atmosphere open channel 123 communicates with the connection channel 44 of the head main body 10. In this manner, a flow channel is formed from the first atmosphere open channel 83, the second atmosphere open channel 123 and the connection channel 44, in which the compliance space 45 communicates with the air chamber 85.

The compliance space 45 (refer to FIG. 8) communicates with the air chamber 85 via such a flow channel, and further is open to the atmosphere, sequentially passing through the communication channel 96, the space 86 and the outward open channel 106.

Since the compliance space 45 is open to the outer atmosphere, the compliance portion 29 can be deformed well corresponding to a pressure change in the manifold 22 similarly to Embodiment 1.

Here, there is a possibility that the moisture contained in the ink inside the manifold 22 (refer to FIG. 7) may be evaporated to permeate the compliance portion 29 and discharged outward via the air chamber 85 to thicken the ink.

However, the outward open channel 106 is configured such that the pressure in the air chamber 85 is adjustable, and has the diffusion resistance to the air. Therefore, excessive evaporation of the moisture from the compliance portion 29 is suppressed.

In addition, a third atmosphere open channel 84 is disposed at the flow channel plate 80, and a fourth atmosphere open channel 124 is disposed at the flow channel plate 120. The third atmosphere open channel 84 is a through hole which is open in both surfaces of the flow channel plate 80 and the fourth atmosphere open channel 124 is a through hole which is open in both surfaces of the flow channel plate 120.

One opening of the third atmosphere open channel 84 communicates with the air chamber 85 and one opening of the fourth atmosphere open channel 124 communicates with the recess 121 of the flow channel plate 120. The recess 121 communicates with the accommodation section 19 of the head main body 10 via the opening 42 of the wiring substrate 41. That is, the accommodation section 19 communicated with the air chamber 85 via the third atmosphere open channel 84, the fourth atmosphere open channel 124 and the recess 121.

In this manner, the accommodation section 19 is open to the atmosphere via the air chamber 85 and the outward open channel 106. Accordingly, it is possible to obtain favorable deformation of the elastic film 25 using the piezoelectric elements 17. Incidentally, if the accommodation section 19 is a sealed space, there is a possibility that the deformation of the elastic film 25 may be inhibited due to the pressure in the accommodation section 19.

Here, the pressure generation chamber 11 is located below the accommodation section 19, being separated from the elastic film 25 (refer to FIG. 8). Depending on the pressure inside the accommodation section 19, the moisture contained in the ink inside the pressure generation chamber 11 is evaporated to permeate the elastic film 25 and discharged outward via the air chamber 85 and the like. If the evaporation of the moisture continues, there is a possibility that the ink may be thickened.

However, the outward open channel 106 is configured such that the pressure in the air chamber 85 is adjustable, and has the diffusion resistance to the air. Therefore, excessive evaporation of the moisture from the elastic film 25 is suppressed, and thereby thickening of the ink is suppressed.

In the above-described head 1B according to the embodiment, the compliance space 45 and the accommodation section 19 are configured to open to the atmosphere via the air chamber 85. Accordingly, it is possible to obtain favorable deformation of the compliance portion 29 and the elastic film 25. Then, since the outward open channel 106 functions as the pressure adjustment section, excessive evaporation of moisture from the compliance portion 29 and the elastic film 25 is suppressed, and thereby thickening of the ink is suppressed.

In addition, in the head 1B, the air chamber 85, the communication channel 96 and the outward open channel 106 are also used for dual purposes, as a flow channel for allowing the compliance space 45 to communicate outward. Therefore, it is possible to simplify the configuration which allows the compliance space 45 to be open to the atmosphere, and thereby it is possible to achieve cost reduction of the head 1B.

Embodiment 4

In Embodiment 1, the first joining portion is set to the adhesive 69 and the second joining portion is set to the seal member 71 (refer to FIG. 5). In Embodiment 4, a head 1C will be described in which both the first joining portion and the second joining portion are set to the adhesive.

Figure 14:
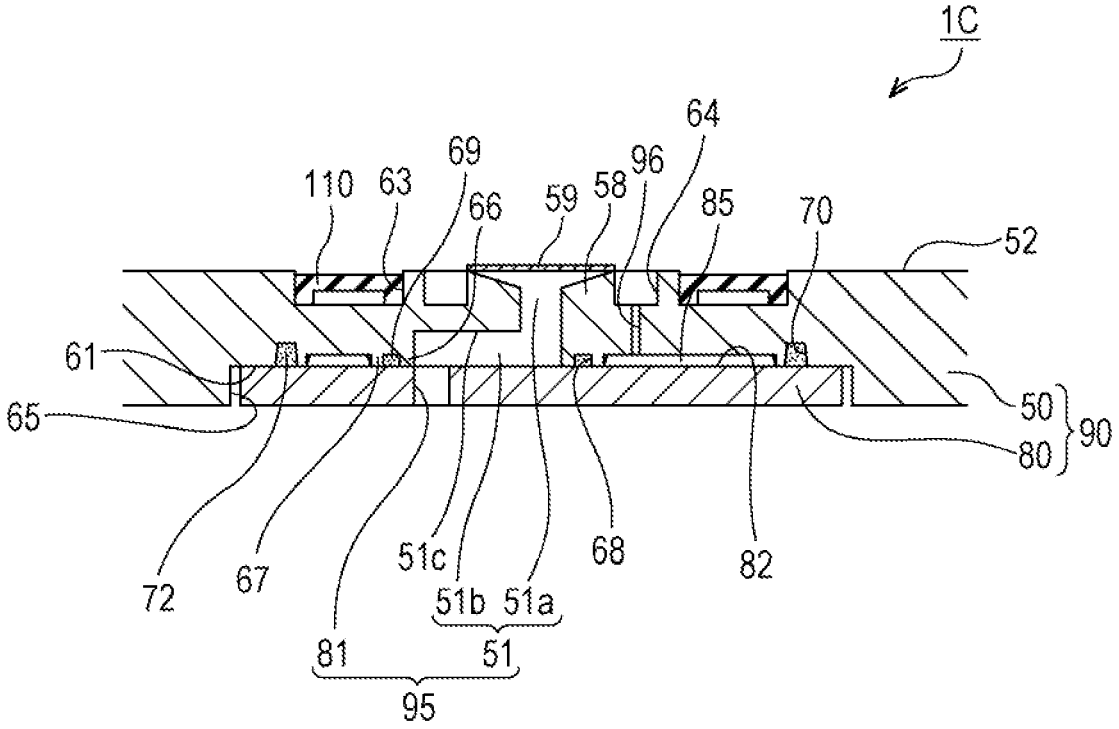
FIG. 14 is a cross-sectional view illustrating a main portion of a flow channel member according to Embodiment 4.

FIG. 14 is a cross-sectional view illustrating a main portion of a flow channel member according to the present embodiment. Further the same reference numerals are given to the same elements as those of Embodiment 1, and the repeated description will be omitted.

As illustrated in FIG. 14, the adhesive 69 is disposed between the first joining surface 61 and the second joining surface 82, as the first joining portion enclosing the openings of the first flow channel 51 (the recess 51*c*) and the second flow channel 81. Furthermore, an adhesive 72 is disposed inside the second groove 70, as the second joining portion enclosing the adhesive 69.

In a case where both the first joining portion and the second joining portion are configured using the adhesive in this manner, it is preferable to use an adhesive with high ink (liquid) resistance such as a silicone-based adhesive, as the adhesive 69 of the first joining portion, and to use an adhesive with low air or vapor permeability such as an epoxy-based adhesive, as the adhesive 72 of the second joining portion.

Using the adhesive with the high ink (liquid) resistance is because it is suitable for the first joining portion enclosing the liquid flow channel 95. In addition, using the adhesive with low air or vapor permeability is because it is possible to ensure airtightness in the air chamber 85.

Although not illustrated, both the first joining portion and the second joining portion may be configured to have the seal member 71. In addition, the first joining portion may be configured to have the seal member 71 and the second joining portion may be configured to have the adhesive.

Embodiment 5

In Embodiment 1, the outward open channel 106 which is elongated and meandering is used for the pressure adjustment section (refer to FIG. 6). In Embodiment 5, a head 1D will be described which uses a filter as the adjustment section.

Figure 15:
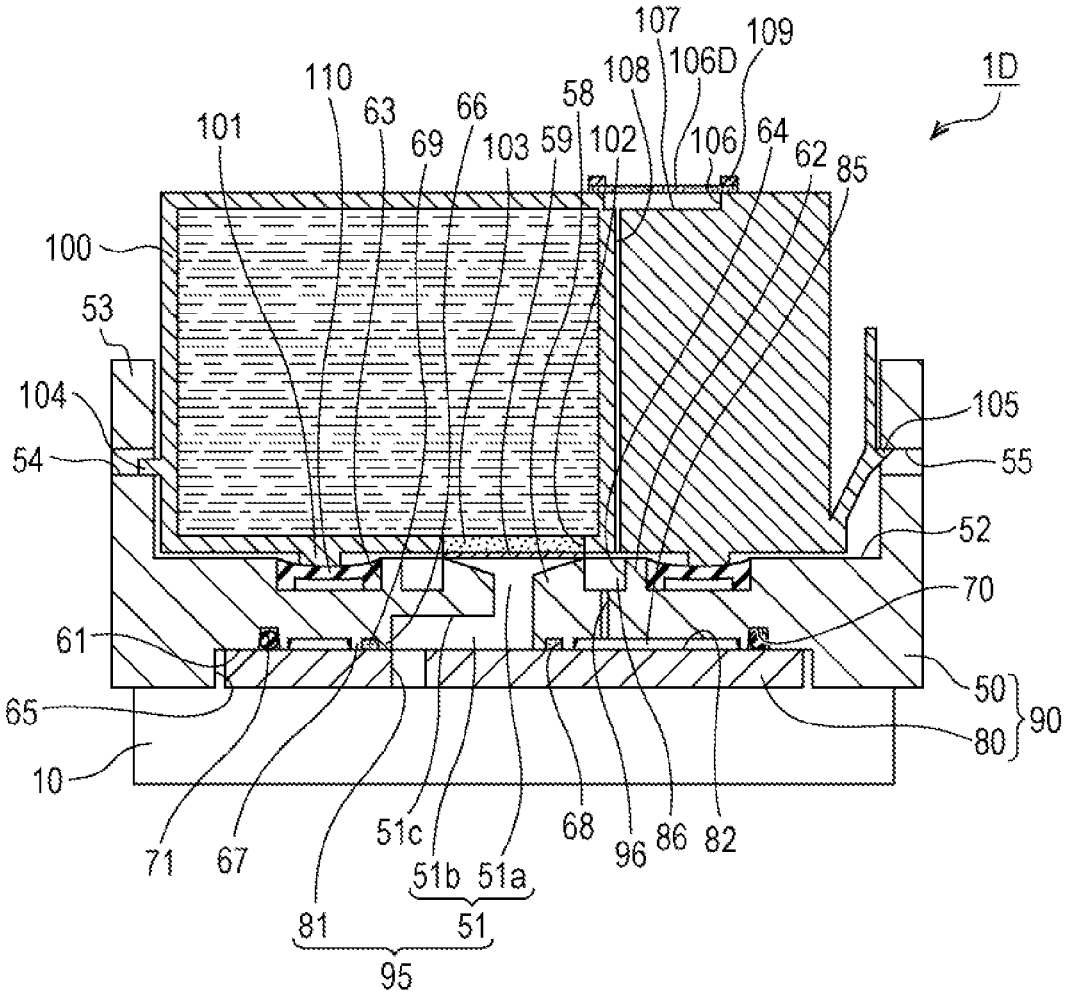
FIG. 15 is a cross-sectional view illustrating a head according to Embodiment 5.

FIG. 15 is a cross-sectional view illustrating the head according to the present embodiment. Further, the same reference numerals are given to the same elements as those in Embodiment 1, and the repeated description will be omitted.

The ink cartridge 100 has a flow channel 108. The flow channel 108 is open to the attachment member 50 side of the ink cartridge 100, and the opening communicates with the space 86 formed in such a manner that the rib 101 and the elastic member 110 are in pressurizing contact with each other. In addition, a recess 107 having a wider opening than the flow channel 108 is formed on an upper surface (an opposite side upper surface to the attachment member 50) of the ink cartridge 100, and the flow channel 108 is open inside the recess 107.

As the pressure adjustment section according to the embodiment, a filter 106D is disposed so as to close the opening of the recess 107. Specifically, the filter 106D is adhered to cover the recess 107, and the filter 106D is fixed to the ink cartridge 100 in such a manner that a joining substrate 109 is joined onto the filter 106D. Further, the joining substrate 109 has an opening which is substantially the same shape as the opening of the recess 107, and the opening and the recess 107 are separated from each other by the filter 106D.

The filter 106D has air permeability. Although the material is not particularly limited, it is possible to use porous materials such as cotton-like pulp, macromolecule absorbing polymer and urethane foam, or non-woven fabric, for example.

Since the filter 106D has the air permeability in this manner, the air chamber 85 communicates outward via the communication channel 96, the flow channel 108 and the filter 106D.

In addition, the filter 106D functions as the diffusion resistance to the air circulating outward from the flow channel 108. Therefore, it is possible to optionally adjust the pressure in the air chamber 85 by appropriately designing a degree of the air permeability of the filter 106D, for example, by appropriately selecting the material.

In this manner, in the head 1D according to the embodiment, similarly to Embodiment 1, the air chamber 85 communicates outward via the communication channel 96, the flow channel 108 and the filter 106D and the inner pressure thereof is adjustable. Therefore, it is possible to maintain a constant pressure by suppressing that temperature changes causes the inside of the air chamber 85 to have an extremely higher pressure or lower pressure as compared to the atmospheric pressure. Accordingly, it is possible to suppress infiltration of the air inside the air chamber 85 into the adhesive 69, which results from a higher pressure than the outside, and to suppress permeation of the air into the liquid flow channel 95.

In this manner, since the ink inside the liquid flow channel 95 does not allow the air to be mixed from the air chamber 85, it is possible to suppress poor ink ejection by suppressing mixed bubbles in the ink. As the flow channel member 90 according to the embodiment, it is possible to supply the ink to other members (in the embodiment, the head main body 10) without allowing the air to be mixed into the liquid flow channel 95 formed from a plurality of members from the air chamber 85 formed on the joining surface of the members.

Another Embodiment

Hitherto, exemplary embodiments of the invention have been described, but a basic configuration of the invention is not limited to those described above. For example, the configurations in Embodiments 1 to 5 described above may be combined, and may be combined with the following modification example.

In the flow channel member 90 according to Embodiments 1 to 5, the air chamber 85 communicates outward via the communication channel 96 and the outward open channel 106 (the filter 106D) as the pressure adjustment section disposed in the ink cartridge 100, but the invention is not limited to such an aspect. That is, the communication channel 96 may not communicate with the outward open channel 106 of the ink cartridge 100 or the filter 106D, but may be open to any position. For example, the communication channel 96 may be open to a surface of the attachment member 50 such as the cartridge mounting section 52. Even in this case, it is possible to suppress infiltration of the air inside the air chamber 85 into the liquid flow channel 95.

Furthermore, the communication channel 96 is formed at the attachment member 50 side configuring the flow channel member 90, but may be formed at the liquid channel plate 80 side.

In addition, the liquid flow channel 95 has the horizontal flow channel 51*b*, but is not necessarily limited to this aspect. That is, the first flow channel (corresponding to the vertical flow channel 51*a*) penetrating the attachment member 50 in the thickness direction and the second flow channel 81 of the flow channel plate 80 are directly connected to form the liquid flow channel 95. Even in this case, the air chamber 85 is defined by the adhesive (the first joining section) disposed so as to enclose the openings of the first flow channel and the second flow channel, the seal member 71 (the second joining section, but it may be the adhesive) outside the adhesive, the first joining surface 61 and the second joining surface 82. Since the air chamber 85 is allowed to communicate outward using the communication channel 96, the same operation effect as that of Embodiment 1 can be achieved.

The pressure generation unit that generates pressure changes in the ink of the pressure generation chamber 11 is not limited to the one described in Embodiment 1. For example, it is possible to use the one in which heating elements are arranged in the liquid flow channel and the ink droplets are ejected from the nozzle using bubbles generated by heat of the heating elements, or a so-called electrostatic actuator which ejects the ink droplets from the nozzle by generating an electrostatic force between the vibrating plate and the electrode and deforming the vibrating plate using the electrostatic force.

Figure 16:
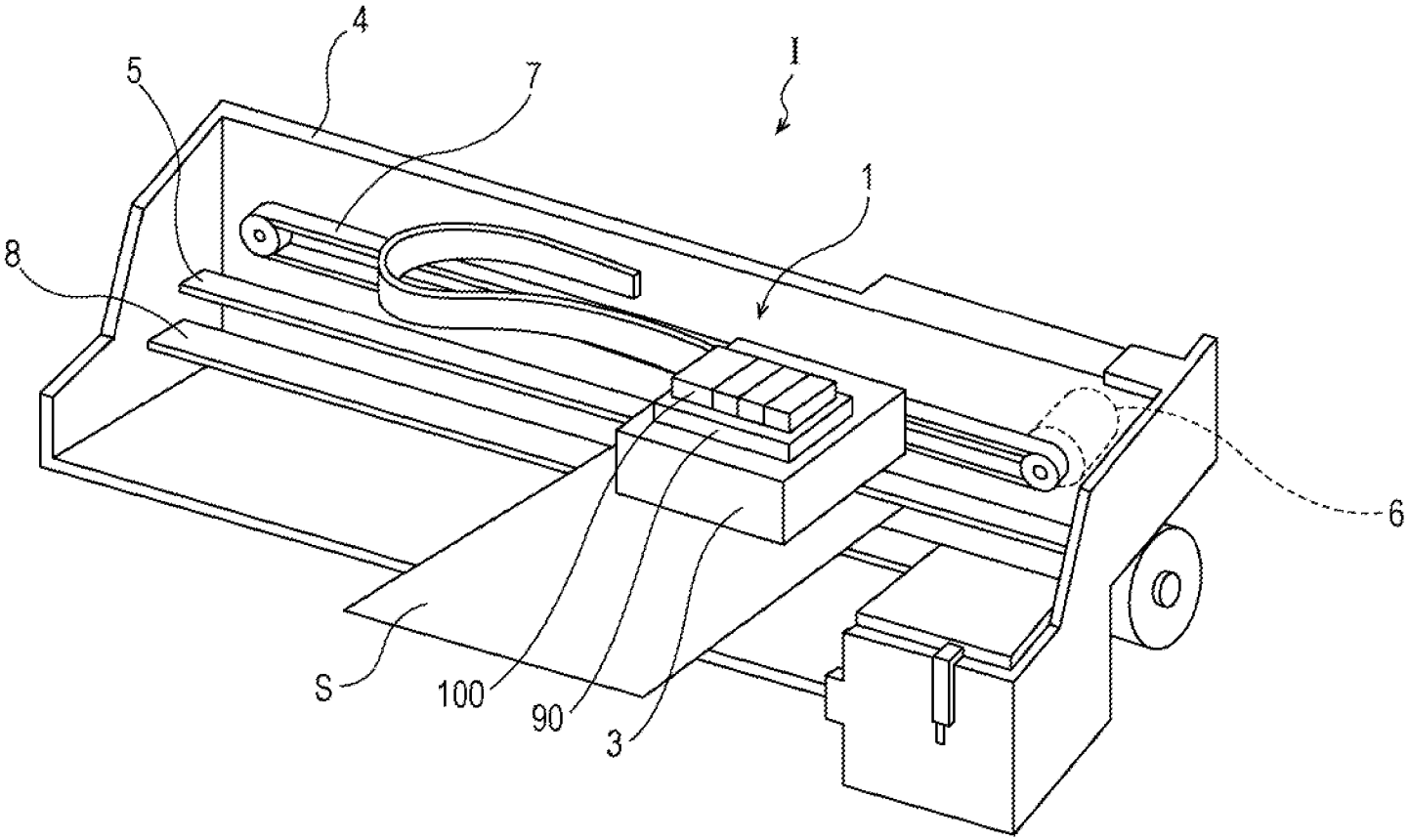
FIG. 16 is a schematic diagram of a recording apparatus according to embodiments.

In addition, the head 1 of one embodiment described above configures a part of the ink jet type recording head unit including the ink flow channel communicating with the ink cartridge and the like, and is mounted on the ink jet type recording apparatus. FIG. 16 is a schematic diagram illustrating an example of the ink jet type recording apparatus.

In the ink jet type recording apparatus I illustrated in FIG. 16, the head 1 is disposed such that the ink cartridge 100 configuring an ink supply unit is attachable and detachable, and a carriage 3 on which the head 1 is mounted is disposed to be axially movable to a carriage shaft 5 attached to an apparatus main body 4. The head 1 ejects black ink composition and color ink composition, for example.

Then, since a drive force of a drive motor 6 is transmitted to the carriage 3 via a plurality of gears (not illustrated) and a timing belt 7, the carriage 3 on which the head 1 is mounted is caused to move along the carriage shaft 5. On the other hand, a platen 8 is disposed in the apparatus main body 4 along the carriage shaft 5, and a recording sheet S which is a recording medium such as a sheet of paper fed by a feed roller (not illustrated) is transported by being wound around the platen 8.

Furthermore, in the above-described example, the head 1 including the flow channel member 90 has been described, but the invention is also applicable to the ink jet type recording apparatus where the flow channel member 90 is disposed at a part except for the head 1. Specifically, in a case of the ink jet type recording apparatus where an ink tank which is a liquid storage unit storing the ink is not mounted on the carriage 3, but is fixed to the apparatus main body 4 such that the ink tank and a head main body 10 are connected to each other using a tubular supply pipe, the above-described flow channel member 90 may be disposed in a place where the ink tank is installed, for example.

In addition, in the above-described ink jet type recording apparatus I, the one in which the head 1 is mounted on the carriage 3 so as to move in a main scanning direction is exemplified, but is not particularly limited thereto. For example, the invention is also applicable to a so-called line type recording apparatus which performs printing only by moving the recording sheet S such as a sheet of paper in a sub-scanning direction, with the head 1 being fixed.

Furthermore, the invention is broadly intended for overall manufacturing methods of the liquid ejecting head, and for example is also applicable to manufacturing methods of a recording head such as various ink jet type recording heads used in an image recording apparatus of a printer, a color material ejecting head used in manufacturing color filter of a liquid crystal display, an electrode material ejecting head used in forming an electrode of an organic EL display or a field emission display (FED) and a bio-organic compound ejecting head used in manufacturing a bio-chip.

In addition, the invention is not limited to the flow channel member to be mounted on the liquid ejecting head and the liquid ejecting apparatus, but is also applicable to the flow channel to be mounted on other devices.

REFERENCE SIGNS LIST

I: ink jet type recording apparatus (liquid ejecting apparatus)
1: head (liquid ejecting head)
10: head main body
29: compliance portion
45: compliance space
50: attachment member
51: first flow channel
51*a*: vertical flow channel
51*b*: horizontal flow channel
61: first joining surface
69: adhesive (first joining section)

71: seal member (second joining section)
80: flow channel plate (second member)
81: second flow channel
82: second joining surface
85: space
90: flow channel member
95: liquid flow channel
96: communication channel
100: ink cartridge
106: outward open channel (pressure adjustment section)

The invention claimed is:

1. A flow channel member comprising:

a first member having a first flow channel communicating with liquid supply means for supplying a liquid;

a second member having a second flow channel downstream from the first flow channel, and being joined to the first member;

a first joining section arranged on joining surfaces where the first member and the second member oppose each other, and enclosing openings of the first flow channel and the second flow channel;

a second joining section arranged on the joining surfaces, enclosing the first joining section; and an air chamber accumulating air between the first joining section and the second joining section, wherein a communication channel allowing the air chamber to communicate outward is disposed inside at least any one of the first member and the second member, wherein the communication channel of the first member does not have a pressure adjustment section adjusting a pressure inside the air chamber, and wherein the communication channel of the first member is capable of communicating with a pressure adjustment section disposed in the liquid supply means to be attached to the first member.

2. The flow channel member according to claim 1, wherein the pressure adjustment section releases the air outward and imparts diffusion resistance to the circulating air.

3. The flow channel member according to claim 1, wherein the first flow channel has a vertical flow channel penetrating the first member in a thickness direction and a horizontal flow channel disposed on the joining surfaces and communicating with the vertical flow channel.

4. The flow channel member according claim 1, wherein the first joining section has a higher air permeability or vapor permeability of a liquid than any one among the second joining section, the first member and the second member.

5. A liquid ejecting head comprising:

the flow channel member according to claim 1; and a head main body.

6. The liquid ejecting head according to claim 5, wherein the head main body has a plurality of nozzles ejecting a liquid, a manifold which becomes a common storage section for the liquid to be supplied to the nozzles, a flexible compliance section partially defining the manifold, and a compliance space disposed to oppose the compliance section, and wherein the compliance space communicates with the air chamber.

7. The liquid ejecting head according to claim 6, wherein a flow channel communicating with the compliance space and the air chamber does not include a pressure adjustment section adjusting a pressure inside the air chamber.

8. A liquid ejecting apparatus comprising:

the liquid ejecting head according to claim 5.

9. A flow channel member comprising:

a first member having a first flow channel communicating with liquid supply means for supplying a liquid;

a second member having a second flow channel downstream from the first flow channel, and being joined to the first member;

a first joining section arranged on joining surfaces where the first member and the second member oppose each other, and enclosing openings of the first flow channel and the second flow channel;

a second joining section arranged on the joining surfaces, enclosing the first joining section; and an air chamber accumulating air between the first joining section and the second joining section, wherein a communication channel allowing the air chamber to communicate outward is disposed inside at least any one of the first member and the second member, wherein the communication channel is capable of communicating with the pressure adjustment section disposed in the liquid supply means to be attached to the first member, and wherein the pressure adjustment section releases the air outward and imparts diffusion resistance to the circulating air.

10. A flow channel member comprising:

a first member having a first flow channel communicating with liquid supply means for supplying a liquid;

a second member having a second flow channel downstream from the first flow channel, and being joined to the first member;

a first joining section arranged on joining surfaces where the first member and the second member oppose each other, and enclosing openings of the first flow channel and the second flow channel;

a second joining section arranged on the joining surfaces, enclosing the first joining section; and an air chamber accumulating air between the first joining section and the second joining section, wherein a communication channel allowing the air chamber to communicate outward is disposed inside at least any one of the first member and the second member, and the first flow channel has a vertical flow channel penetrating the first member in a thickness direction and a horizontal flow channel disposed on the joining surfaces and communicating with the vertical flow channel.

11. A flow channel member comprising:

a first member having a first flow channel communicating with liquid supply means for supplying a liquid;

a second member having a second flow channel downstream from the first flow channel, and being joined to the first member;

a first joining section arranged on joining surfaces where the first member and the second member oppose each other, and enclosing openings of the first flow channel and the second flow channel;

a second joining section arranged on the joining surfaces, enclosing the first joining section; and an air chamber accumulating air between the first joining section and the second joining section, wherein a communication channel allowing the air chamber to communicate outward is disposed inside at least any one of the first member and the second member, and the first joining section has a higher air permeability or vapor permeability of a liquid than any one among the second joining section, the first member and the second member.

12. The flow channel member according to claim 9, wherein the pressure adjustment section releases the air outward and imparts diffusion resistance to the circulating air.

13. The flow channel member according to claim 10, wherein the pressure adjustment section releases the air outward and imparts diffusion resistance to the circulating air.

14. The flow channel member according to claim 11, wherein the pressure adjustment section releases the air outward and imparts diffusion resistance to the circulating air.

15. The flow channel member according to claim 9, wherein the first flow channel has a vertical flow channel penetrating the first member in a thickness direction and a horizontal flow channel disposed on the joining surfaces and communicating with the vertical flow channel.

16. The flow channel member according to claim 11, wherein the first flow channel has a vertical flow channel penetrating the first member in a thickness direction and a horizontal flow channel disposed on the joining surfaces and communicating with the vertical flow channel.

17. The flow channel member according to claim 9, wherein the first joining section has a higher air permeability or vapor permeability of a liquid than any one among the second joining section, the first member and the second member.

18. The flow channel member according to claim 10, wherein the first joining section has a higher air permeability or vapor permeability of a liquid than any one among the second joining section, the first member and the second member.

19. The flow channel member according to claim 14, wherein the first joining section has a higher air permeability or vapor permeability of a liquid than any one among the second joining section, the first member and the second member.

* * * * *